US010319196B2

(12) United States Patent
Elias et al.

(10) Patent No.: US 10,319,196 B2
(45) Date of Patent: Jun. 11, 2019

(54) SYSTEMS AND METHODS FOR SLOT-STYLE GAMES

(71) Applicant: Gamesys Ltd., London (GB)

(72) Inventors: Hans Elias, St. Albans (GB); Marlon James Dublin, Ilford (GB)

(73) Assignee: Gamesys Ltd., London (GB)

( * ) Notice: Subject to any disclaimer, the term of this patent is extended or adjusted under 35 U.S.C. 154(b) by 0 days.

(21) Appl. No.: 15/924,478

(22) Filed: Mar. 19, 2018

(65) Prior Publication Data

US 2018/0211495 A1 Jul. 26, 2018

Related U.S. Application Data

(62) Division of application No. 15/657,323, filed on Jul. 24, 2017, now abandoned, which is a division of application No. 14/504,717, filed on Oct. 2, 2014, now Pat. No. 9,728,050.

(60) Provisional application No. 62/046,231, filed on Sep. 5, 2014, provisional application No. 61/885,557, filed on Oct. 2, 2013.

(51) Int. Cl.
*G07F 17/32* (2006.01)
*G07F 17/34* (2006.01)

(52) U.S. Cl.
CPC ..... *G07F 17/34* (2013.01); *G07F 17/326* (2013.01); *G07F 17/3213* (2013.01)

(58) Field of Classification Search
CPC .. G07F 17/32; G07F 17/3211; G07F 17/3213; G07F 17/3267
See application file for complete search history.

(56) References Cited

U.S. PATENT DOCUMENTS 5,833,537 A 11/1998 Barrie
5,980,384 A * 11/1999 Barrie ..... G07F 17/3265 273/138.1
6,319,124 B1 11/2001 Baerlocher et al.
6,375,570 B1 * 4/2002 Poole ..... G07F 17/3211 463/20
6,517,432 B1 2/2003 Jaffe
6,731,313 B1 * 5/2004 Kaminkow ..... G07F 17/3265 715/747
6,786,818 B1 * 9/2004 Rothschild ..... G07F 17/32 436/16
6,805,632 B2 * 10/2004 Suda ..... G07F 17/32 463/16
6,896,615 B2 5/2005 Berman
6,910,962 B2 6/2005 Marks et al.
6,921,335 B2 * 7/2005 Rodgers ..... G07F 17/3265 273/138.1
7,014,559 B1 3/2006 Fong
7,144,322 B2 12/2006 Gomez et al.
7,347,777 B2 3/2008 Gauselmann
7,357,713 B2 4/2008 Marks et al.
(Continued)

OTHER PUBLICATIONS

Written Opinion for Application No. PCT/US2014/058762 dated Feb. 12, 2015; 4 pps.

(Continued)

*Primary Examiner* — Steven J Hylinski
(74) *Attorney, Agent, or Firm* — Fincham Downs, LLC; Carson C.K. Fincham

(57) ABSTRACT

Systems, methods, and articles of manufacture provide for new features and functionality of slot-style games.

5 Claims, 21 Drawing Sheets

(56) References Cited

U.S. PATENT DOCUMENTS 7,553,231 B2 6/2009 Rodgers et al.
7,611,406 B2 11/2009 Fuller
7,749,063 B2 7/2010 Belger et al.
7,850,519 B2 12/2010 Majima et al.
7,874,910 B2 1/2011 Berman
8,083,581 B2 12/2011 Marks et al.
8,105,151 B2 1/2012 Caputo et al.
8,152,623 B2 4/2012 Fiden
8,177,622 B2 5/2012 Englman
8,192,272 B2 6/2012 Thomas et al.
8,192,275 B2 6/2012 Aoki et al.
8,246,447 B2 8/2012 Gauselman
8,251,798 B2 8/2012 Belger et al.
8,366,538 B1 2/2013 Saunders et al.
8,371,930 B1 2/2013 Saunders et al.
8,414,380 B2 4/2013 Saunders et al.
8,430,737 B2 4/2013 Saunders
8,444,473 B2 5/2013 Ching et al.
8,454,429 B2 6/2013 Jaffe et al.
8,512,138 B2 8/2013 Saunders
8,523,659 B2 9/2013 Evans
8,662,986 B2 * 3/2014 Rodgers ..... G07F 17/3262 463/20
8,814,656 B2 8/2014 Caputo
8,840,457 B1 9/2014 Basallo et al.
9,177,447 B2 11/2015 Zoltewicz et al.
9,646,458 B2 * 5/2017 Zielinski ..... G07F 17/32
2003/0060267 A1 3/2003 Glavich et al.
2003/0064779 A1 4/2003 Suda
2003/0064802 A1 4/2003 Rodgers et al.
2003/0092480 A1 5/2003 White et al.
2004/0023714 A1 * 2/2004 Asdale ..... G07F 17/32 463/22
2004/0058727 A1 3/2004 Marks et al.
2004/0242313 A1 12/2004 Munoz
2005/0009596 A1 1/2005 Daly
2006/0046830 A1 3/2006 Webb
2006/0068881 A1 3/2006 Casey
2008/0090655 A1 4/2008 Marks et al.
2008/0108413 A1 5/2008 Gelber et al.
2009/0069071 A1 * 3/2009 Aoki ..... G07F 17/34 463/20
2009/0186684 A1 * 7/2009 Visser ..... G07F 17/3267 463/20
2010/0004049 A1 * 1/2010 Ching ..... G07F 17/3267 463/20
2010/0062827 A1 3/2010 Hoffman et al.
2011/0111830 A1 5/2011 Seeling et al.
2012/0064961 A1 3/2012 Vancura
2012/0238348 A1 9/2012 Aoki et al.
2013/0023325 A1 * 1/2013 Saunders ..... G07F 17/32 463/20
2013/0150144 A1 6/2013 Watkins et al.
2013/0184048 A1 7/2013 Singer et al.
2013/0190067 A1 7/2013 Saunders
2013/0252699 A1 9/2013 Nauman et al.
2014/0031100 A1 1/2014 Gomez et al.
2014/0094248 A1 3/2014 Vancura
2014/0248936 A1 9/2014 Basallo et al.

OTHER PUBLICATIONS

International Search Report for Application No. PCT/US2014/058762 dated Feb. 12, 2015; 2 pps.
Written Opinion for Application No. PCT/US2015/032602 dated Aug. 25, 2015; 12 pps.
International Search Report for Application No. PCT/US2015/032602 dated Aug. 25, 2015; 12 pps.
Office Action for Application No. 14/504,717 dated Nov. 21, 2016; 6 pps.
Notice of Allowance for Application No. 14/504,717 dated May 31, 2017; 9 pps.
Office Action for Application No. 15/657,323 dated Jan. 8, 2018; 9 pps.

* cited by examiner

SYSTEMS AND METHODS FOR SLOT-STYLE GAMES

CROSS-REFERENCE TO RELATED APPLICATIONS

This application claims benefit and priority under 35 U.S.C. § 120 to, and is a Divisional of, U.S. patent application Ser. No. 15/657,323 titled "SYSTEMS AND METHODS FOR SLOT-STYLE GAMES" and filed on Jul. 24, 2017, which itself claims benefit and priority to and is a Divisional of, U.S. patent application Ser. No. 14/504,717 titled "SYSTEMS AND METHODS FOR SLOT-STYLE GAMES" and filed on Oct. 2, 2014 and issued as U.S. Pat. No. 9,728,050 on Aug. 8, 2017, which itself claims benefit and priority under 35 U.S.C. § 119(e) to, and is a non-provisional of, (i) U.S. Provisional Patent No. 61/885,557 titled "SYSTEMS AND METHODS FOR SLOT-STYLE GAMES" and filed on Oct. 2, 2013, and (ii) U.S. Provisional Patent No. 62/046,231 titled "SYSTEMS AND METHODS FOR SLOT-STYLE GAMES" and filed on Sep. 5, 2014, the contents of each of which are hereby incorporated by reference herein.

BACKGROUND

Social and/or wagering games of various types of such as online, offline, skill-based, games of chance, and games of mixed skill and chance are a continued source of entertainment to game players, and are often a source of great revenue for gaming companies. One of the most popular styles of games, and one of the most consistently lucrative for the gaming industry, are those games having actual and/or simulated slot reels—i.e., "slot-style" games. A great many variants of slot style games have been introduced in the marketplace in an attempt to capture player excitement and maintain player enthusiasm and involvement. Accordingly, there is a desire to provide players with increasingly newer, more interesting, engaging, or entertaining slot-style games.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Figure 1:
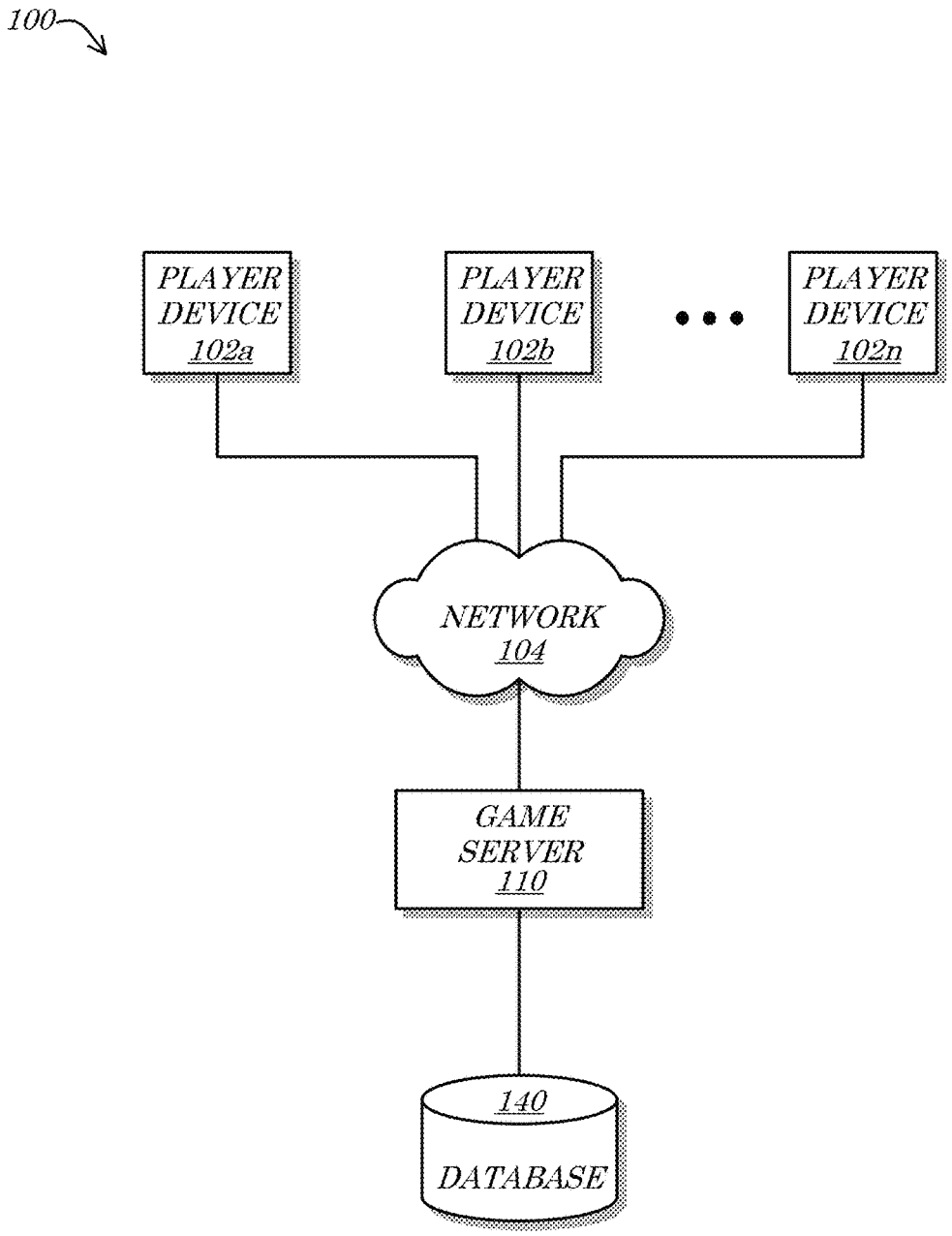
FIG. 1 is a block diagram of a system according to some embodiments.

Embodiments presented herein are descriptive of systems, apparatus, methods, and articles of manufacture for new features and functionality of slot-style games. In some embodiments, a slot-style game may comprise a free spin (or free partial spin) mechanism that causes slot reels to rotate (e.g., slowly, such as in a "nudging" manner) based on symbol elements that pass into, through, or out of designated reel positions. According to some embodiments, reel symbols of a slot-style game may comprise multiple states (e.g., a primary state and a secondary state). In some embodiments, one or more of such states (e.g., the secondary state) may be utilized to define symbol behavior, such as with respect to symbol removal mechanics. In some embodiments, a three-dimensional array of reel symbols may be determined. According to some embodiments, removal of reel symbols may cause reel symbols to be shifted from one portion of the three-dimensional array to, e.g., a position from which a reel symbol has been removed. In some embodiments, symbols removed from a primary matrix of a slot-style game may be populated in a secondary matrix of the slot-style game. In some embodiments, the secondary matrix may be resolved to produce game results in a manner different than the primary matrix.

II. Terms and Definitions

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. While not generally limiting and while not limiting for all described embodiments, in some embodiments, the terms are specifically limited to the example definitions and/or examples provided. Other terms are defined generally throughout the present description.

A "game", as the term is utilized herein (unless otherwise specified), may generally comprise any game (e.g., wagering or non-wagering, skill-based, chance-based, playable by hand (e.g., utilizing non-electric physical components, boards, and/or pieces), and/or electronically playable over a network) playable by one or more players in accordance with specified rules. An electronic game may be playable on a Personal Computer (PC), online in web browsers, on a game console, and/or on a mobile device such as a smartphone or tablet computer. "Gaming" thus generally refers to play of a game (e.g., by one or more players).

A "slot-style game", as the term is utilized herein (unless otherwise specified), generally refers to a game comprising one or more physical and/or virtual (e.g., simulated) slot reels and/or positions. While physical and/or simulated reels may "spin" or cycle through a plurality of possible outcomes before landing or stopping on specific symbols representing an outcome of an instance of the game, other electronic slot-style games may comprise a matrix of outcome positions that are filled or populated with symbols representing an outcome of the instance of the game (e.g., typically referred to as "cascading" or "tumbling reel" slots). Slot reel outcomes may be populated randomly or pseudo-randomly or may be predetermined (and/or determined based on a predetermined and/or desired result) and made to appear random. Slot-style games are typically games of chance and may comprise "casual games", "social network games", and/or "wagering games".

A "casual game", as the term is utilized herein (unless otherwise specified), may generally comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as utilized herein (unless otherwise specified), generally refers to a type of online game that is played through a social network, and in some embodiments may feature multiplayer and/or asynchronous game play mechanics. A "social network" may refer to an online service, online community, platform, and/or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a web browser and/or web-client game, a Flash®, or Java®-scripted game, and/or may be implemented on one or more mobile platforms such as on portable electronic devices.

A "wagering game", as the term is utilized herein (unless otherwise specified), may generally comprise a game in which a player can risk a wager or other consideration, such as, but not limited to: slot-style games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" generally refers to play of a wagering game.

The term "game provider", as utilized herein (unless otherwise specified), generally refers to an entity or system of components which provides games for play and facilitates play of such game by use of a network such as the Internet or a proprietary or closed networks (e.g., an intranet or local or wide area network). For example, a game provider may operate a website which provides games in a digital format over the Internet. In some embodiments in which a game comprising a wagering game is provided, a game provider may operate a gambling website over which wagers are accepted and results (e.g., winnings) of wagering games are provided.

As utilized herein, the term "player" may generally refer to any type, quantity, and or manner of entity associated with the play of a game. In some embodiments, a player may comprise an entity conducting play of an online game, for example, may comprise an entity that desires to play a game (e.g., an entity registered and/or scheduled to play and/or an entity having expressed interest in the play of the game—e.g., a spectator) and/or may comprise an entity that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game). In some embodiments, a player may comprise an individual (or group) that enters, joins, logs into, registers for, and/or otherwise access an online game room, session, server, and/or other particular instance and/or segmentation of an online game.

Some embodiments described herein are associated with a "player device" or a "network device". As utilized herein, a "player device" is a subset of a "network device". The "network device", for example, may generally refer to any device that can communicate via a network, while the "player device" may comprise a network device that is owned and/or operated by or otherwise associated with a player (e.g., a network device specifically configured to permit use thereof by the player, such as by receiving login credentials from the player). Examples of player and/or network devices may include, but are not limited to: a PC, a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components. In some embodiments, a player device may comprise an electronic device configured to initiate, conduct, facilitate, and/or otherwise permit player participation in an electronic game.

As utilized herein, the term "network component" may refer to a player or network device, or a component, piece, portion, or combination of player or network devices. Examples of network components may include a Static Random Access Memory (SRAM) device or module, a network processor, and a network communication path, connection, port, or cable.

In addition, some embodiments are associated with a "network" or a "communication network." As utilized herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration or type that is or becomes known. Communication networks may include, for example, devices that communicate directly or indirectly, via a wired or wireless medium such as the Internet, intranet, a Local Area Network (LAN), a Wide Area Network (WAN), a cellular telephone network, a Bluetooth® network, a Near-Field Communication (NFC) network, a Radio Frequency (RF) network, a Virtual Private Network (VPN), Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), and/or system to system (S2S).

As utilized herein, the terms "information" and "data" may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard. Information may, according to some embodiments, be compressed, encoded, encrypted, and/or otherwise packaged or manipulated in accordance with any method that is or becomes known or practicable.

The term "indication", as utilized herein (unless otherwise specified), may generally refer to any indicia and/or other information indicative of or associated with a subject, item, entity, and/or other object and/or idea. As utilized herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

A "session", as the term is utilized herein (unless otherwise specified), may generally comprise a period of time spanning a plurality of event instances (e.g., with respect to a communication and/or game session) or turns of a game, the session having a defined start and defined end. An event instance or turn is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance).

As utilized herein, the terms "outcome" and "result" should be differentiated in the present description in that an "outcome" is generally a representation of a "result", typically comprising one or more game elements or game symbols. For example, in a "fruit themed" slot-style game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three (3) spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass awards, prizes and payouts which are monetary, non-monetary, tangible or intangible.

As utilized herein, the term "virtual currency" may generally refer to an in-game currency that may be utilized as part of a game or one or more games provided by a game provider as (i) currency for making wagers, and/or (ii) to purchase or access various in-game items, features or powers (e.g., "freemium" upgrades and/or options).

A "credit balance", as the term is utilized herein (unless otherwise specified), may generally refer to (i) a balance of currency, whether virtual currency and/or real currency, usable for making wagers and/or purchases in a game and/or (ii) another tracking mechanism for tracking a player's success or advancement in a game by deducting there from points or value for unsuccessful attempts at advancement and adding thereto points or value for successful attempts at advancement.

Some embodiments are descriptive of an "array" or "matrix" of symbols or game outcomes. As utilized herein, the terms "array" and "matrix" generally refer to a group of symbols, numbers, and/or expressions arranged in a plurality of rows and columns (or that can be readily and appropriately represented mathematically as being so arranged). In some embodiments, the term "array" is utilized to refer to a multi-dimensional matrix or combination of matrices while the term "matrix" is utilized to refer to a two-dimensional set of symbols or numbers (e.g., slot reel symbols and/or mathematical representations thereof). According to some embodiments, such as in the case that an array and/or matrix is populated with graphical game symbols, the array or matrix may be output and/or displayed (e.g., transmit to and/or rendered on a player device) as part of a game session.

III. Systems

Turning first to FIG. 1, a block diagram of a system 100 according to some embodiments is shown. In some embodiments, the system 100 may comprise a gaming platform such as a gaming platform via which one or more multi-player and/or online games may be played (e.g., one or more slot-style games as described herein). In some embodiments, the system 100 may comprise a plurality of player devices 102*a-n* in communication with and/or via a network 104. In some embodiments, a game server 110 may be in communication with the network 104 and/or one or more of the player devices 102*a-n*. In some embodiments, the game server 110 (and/or the player devices 102*a-n*) may be in communication with a database 140. The database 140 may store, for example, game date (e.g., processed and/or defined by the game server 110), data associated with players (not explicitly shown) owning and/or operating the player devices 102*a-n*, and/or instructions that cause various devices (e.g., the game server 110 and/or the player devices 102*a-n*) to operate in accordance with embodiments described herein.

According to some embodiments, any or all of the components 102*a-n*, 104, 110, 140 of the system 100 may be similar in configuration and/or functionality to any similarly named and/or numbered components described herein.

Fewer or more components 102*a-n*, 104, 110, 140 (and/or portions thereof) and/or various configurations of the components 102*a-n*, 104, 110, 140 may be included in the system 100 without deviating from the scope of embodiments described herein. While multiple instances of some components 102*a-n* are depicted and while single instances of other components 104, 110, 140 are depicted, for example, any component 102*a-n*, 104, 110, 140 depicted in the system 100 may comprise a single device, a combination of devices and/or components 102*a-n*, 104, 110, 140, and/or a plurality of devices, as is or becomes desirable and/or practicable. Similarly, in some embodiments, one or more of the various components 102*a-n*, 104, 110, 140 may not be needed and/or desired in the system 100.

The player devices 102*a-n*, in some embodiments, may comprise any type or configuration of electronic, mobile electronic, and or other network and/or communication devices (or combinations thereof) that are or become known or practicable. A first player device 102*a* may, for example, comprise one or more PC devices, computer workstations (e.g., game consoles and/or gaming computers), tablet computers, such as an iPad® manufactured by Apple®, Inc. of Cupertino, Calif., and/or cellular and/or wireless telephones such as an iPhone® (also manufactured by Apple®, Inc.) or an Optimus™ S smart phone manufactured by LG® Electronics, Inc. of San Diego, Calif., and running the Android® operating system from Google®, Inc. of Mountain View, Calif. In some embodiments, one or more of the player devices 102*a-n* may be specifically utilized and/or configured (e.g., via specially-programmed and/or stored instructions such as may define or comprise a software application) to communicate with the game server 110 (e.g., via the network 104).

The network 104 may, according to some embodiments, comprise a LAN, WAN, cellular telephone network, Bluetooth® network, NFC network, and/or RF network with communication links between the player devices 102*a-n*, the game server 110, and/or the database 140. In some embodiments, the network 104 may comprise direct communications links between any or all of the components 102*a-n*, 110, 140 of the system 100. The game server 110 may, for example, be directly interfaced or connected to the database 140 via one or more wires, cables, wireless links, and/or other network components, such network components (e.g., communication links) comprising portions of the network 104. In some embodiments, the network 104 may comprise one or many other links or network components other than those depicted in FIG. 1. A second player device 102*b* may, for example, be connected to the game server 110 via various cell towers, routers, repeaters, ports, switches, and/or other network components that comprise the Internet and/or a cellular telephone (and/or Public Switched Telephone Network (PSTN)) network, and which comprise portions of the network 104.

While the network 104 is depicted in FIG. 1 as a single object, the network 104 may comprise any number, type, and/or configuration of networks that is or becomes known or practicable. According to some embodiments, the network 104 may comprise a conglomeration of different sub-networks and/or network components interconnected, directly or indirectly, by the components 102*a-n*, 110, 140 of the system 100. The network 104 may comprise one or more cellular telephone networks with communication links between the player devices 102*a-n* and the game server 110, for example, and/or may comprise the Internet, with communication links between the player devices 102*a-n* and the database 140, for example.

According to some embodiments, the game server 110 may comprise a device (and/or system) owned and/or operated by or on behalf of or for the benefit of a game provider (not explicitly shown). The game provider may utilize player and/or game information or instructions (e.g., stored by the database 140), in some embodiments, to host, manage, analyze, design, define, price, conduct, and/or otherwise provide (or cause to be provided) one or more games such as online single-player or multiplayer games (e.g., one or more slot-style games as described herein). In some embodiments, the game provider (and/or a third-party; not explicitly shown) may provide an interface (not shown in FIG. 1; such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein) to and/or via the player devices 102*a-n*. The interface(s) may be configured, according to some embodiments, to allow and/or facilitate electronic game play by one or more players. In some embodiments, the system 100 (and/or interface provided by the game server 110) may present game data (e.g., from the database 140) in such a manner that allows players to participate in one or more online games (singularly, in/with groups, and/or otherwise). According to some embodiments, the game server 110 may cause and/or facilitate various functionality and/or features of one or more slot-style games, each as described herein.

In some embodiments, the database 140 may comprise any type, configuration, and/or quantity of data storage devices that are or become known or practicable. The database 140 may, for example, comprise an array of optical and/or solid-state hard drives configured to store player and/or game data, and/or various operating instructions, drivers, etc. While the database 140 is depicted as a stand-alone component of the system 100 in FIG. 1, the database 140 may comprise multiple components. In some embodiments, a multi-component database 140 may be distributed across various devices and/or may comprise remotely dispersed components. Any or all of the player devices 102*a-n* may comprise the database 140 or a portion thereof, for example, and/or the game server 110 may comprise the database 140 or a portion thereof.

According to some embodiments, any or all of the player devices 102*a-n* in conjunction with one or more of the game server 110 and/or the database 140 (e.g., via the network 104) may conduct (in whole or in part), facilitate, and/or otherwise be associated with execution of one or more stored procedures, applications, processes, and/or methods (e.g., the methods 600, 800, 1000, 1200, 1400 of FIG. 6, FIG. 8, FIG. 10, FIG. 12, and/or FIG. 14 herein, and/or one or more portions and/or combinations thereof) as described herein.

Figure 2:
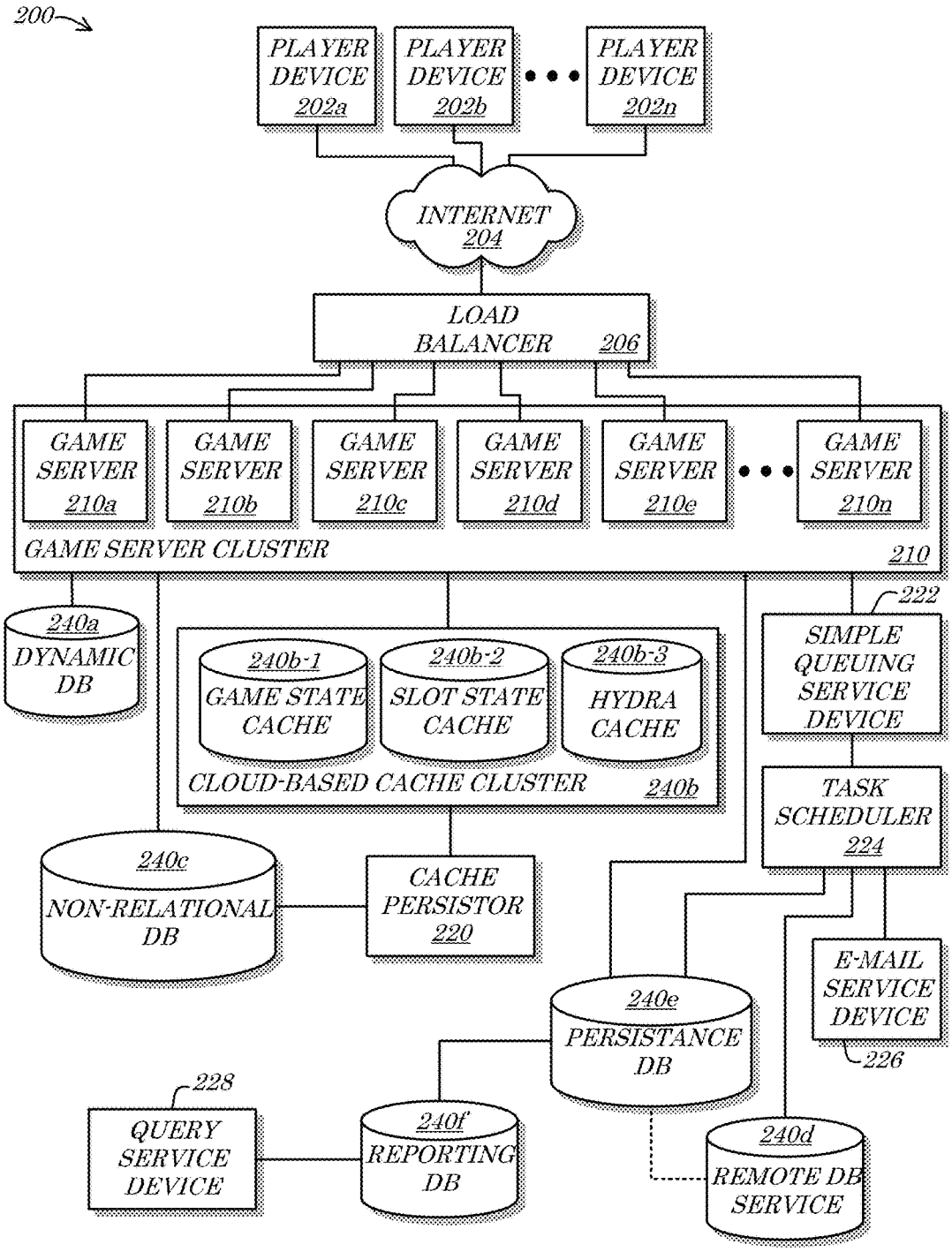
FIG. 2 is a block diagram of a system according to some embodiments.

Referring now to FIG. 2, a block diagram of a system 200 according to some embodiments is shown. In some embodiments, the system 200 may comprise a gaming platform such as a platform via which social, single-player, multi-player, and/or online games may be played (e.g., one or more slot-style games as described herein). In some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player devices 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slot-style games, poker, and/or other games of chance, skill, and/or combinations thereof. In some embodiments, the various game servers 210*a-n* (virtual and/or physical) of the game server cluster 210 may be configured to provide, manage, host, and/or conduct individual instances and/or sessions of available game types. A first game server 210*a*, for example, may host a first particular session of an online bingo game (or tournament), a second game server 210*c* may host a second particular session of an online bingo game (or tournament), a third game server 210*c* may facilitate an online poker tournament (e.g., and a corresponding plurality of game sessions that comprise the tournament), and/or a fourth game server 210*d* may provide an online slots game (e.g., by hosting one or more slot game sessions).

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer (not explicitly shown in FIG. 2). In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/"stickiness"). In some embodiments, the load balancer 206 may comprise one or more devices and/or services provided by a third-party (not separately shown in FIG. 2). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for specific game types such as bingo, the game server cluster 210 may provide game results (such as a full set of drawn bingo numbers and/or bonus metrics) to a controller device (not separately shown in FIG. 2) that times the release of game result information to the player devices 202*a-n* such as by utilizing a broadcaster device (also not separately shown in FIG. 2) that transmits the time-released game results to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., slot-style games) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, referral data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistior 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

According to some embodiments, any or all of the player devices 202*a-n* in conjunction with one or more of the game servers 210*a-n* and/or the databases 240*a-f* (e.g., via the network 204) may conduct (in whole or in part), facilitate, and/or otherwise be associated with execution of one or more stored procedures, applications, processes, and/or methods (e.g., the methods 600, 800, 1000, 1200, 1400 of FIG. 6, FIG. 8, FIG. 10, FIG. 12, and/or FIG. 14 herein, and/or one or more portions and/or combinations thereof) as described herein.

Figure 3:
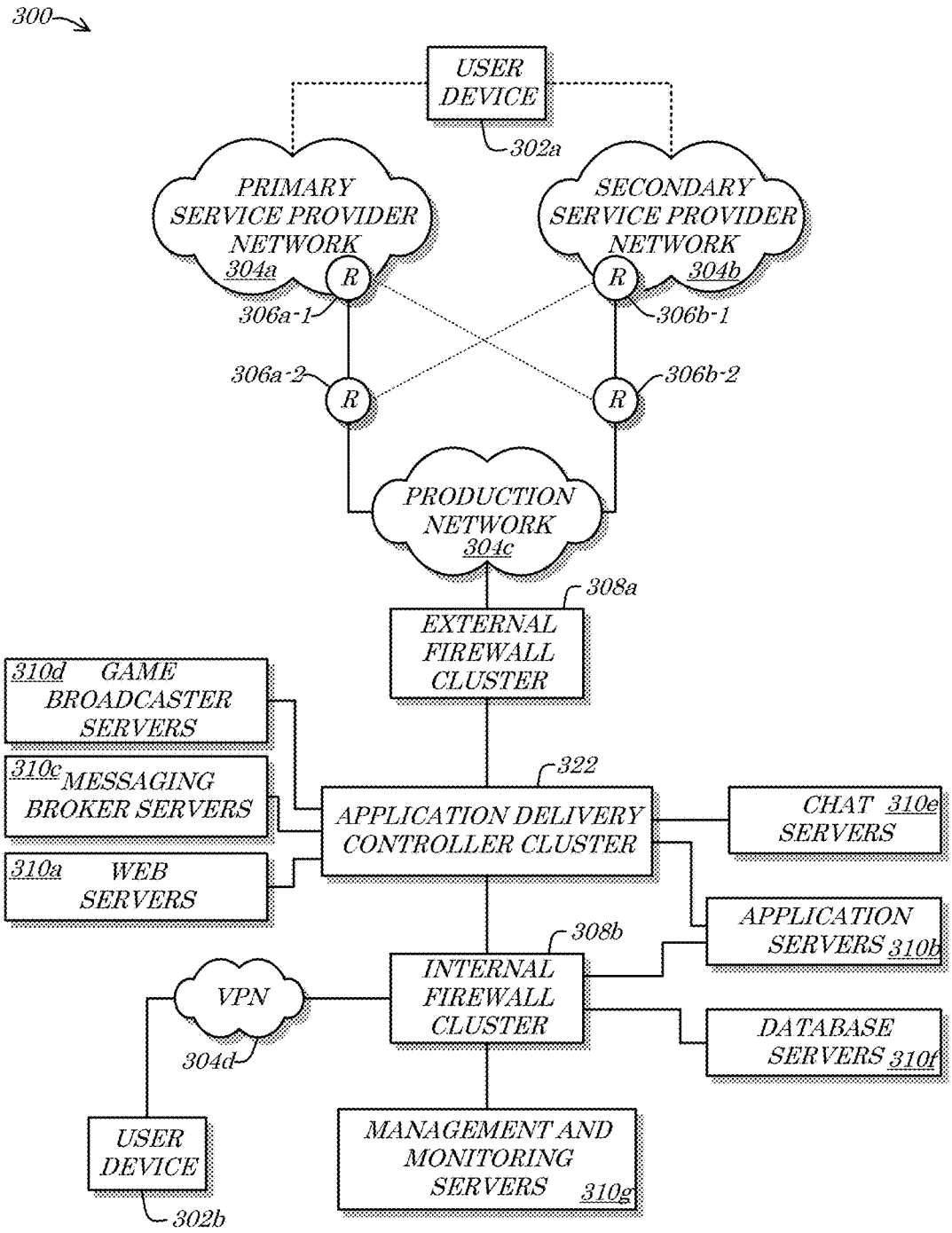
FIG. 3 is a block diagram of a system according to some embodiments.

Turning now to FIG. 3, a block diagram of a system 300 according to some embodiments is shown. In some embodiments, the system 300 may comprise and/or define a "front-end" architecture of a gaming platform such as a platform via which social, single-player, multiplayer, and/or online games may be played (e.g., one or more slot-style games as described herein). In some embodiments, the system 300 may comprise a plurality of user devices 302*a-b*, a plurality of networks 304*a-b* (e.g., a primary service provider network 304*a*, a secondary service provider network 304*b*, a production network 304*c*, and/or a VPN 304*d*), a plurality of routers 306*a-b*, a plurality of firewall devices 308*a-b*, a plurality of game servers 310*a-g* (e.g., web servers 310*a*, application servers 310*b*, messaging broker servers 310*c*, game broadcaster servers 310*d*, chat servers 310*e*, database servers 310*f*, and/or management and monitoring servers 310*g*), and/or an application delivery controller cluster 322.

According to some embodiments, any or all of the components 302*a-b*, 304*a-b*, 306*a-b*, 308*a-b*, 310*a-g*, 322 of the system 300 may be similar in configuration and/or functionality to any similarly named and/or numbered components described herein. Fewer or more components 302*a-b*, 304*a-b*, 306*a-b*, 308*a-b*, 310*a-g*, 322 (and/or portions thereof) and/or various configurations of the components 302*a-b*, 304*a-b*, 306*a-b*, 308*a-b*, 310*a-g*, 322 may be included in the system 300 without deviating from the scope of embodiments described herein. While multiple instances of some components 302*a-b*, 304*a-b*, 306*a-b*, 308*a-b*, 310*a-g* are depicted and while single instances of other components 322 are depicted, for example, any component 302*a-b*, 304*a-b*, 306*a-b*, 308*a-b*, 310*a-g*, 322 depicted in the system 300 may comprise a single device, a combination of devices and/or components 302*a-b*, 304*a-b*, 306*a-b*, 308*a-b*, 310*a-g*, 322, and/or a plurality of devices, as is or becomes desirable and/or practicable. Similarly, in some embodiments, one or more of the various components 302*a-b*, 304*a-b*, 306*a-b*, 308*a-b*, 310*a-g*, 322 may not be needed and/or desired in the system 300.

In some embodiments, a first user device 302*a* may comprise an electronic device owned and/or operated by a player of an online game (not explicitly shown) and/or by an entity that otherwise accesses online game content and/or services externally (e.g., requiring external login and/or access credentials and/or procedures). The first user device

302*a* may, for example, be utilized to access content provided by and/or via the application delivery controller cluster 322. In some embodiments, the first user device 302*a* may interface with and/or connect to the production network 304*c* via the primary service provider network 304*a* and/or the secondary service provider network 304*b*. The primary service provider network 304*a* and the secondary service provider network 304*b* may, for example, load balance and/or provide redundant coverage for outage recovery by utilization of a first primary service provider network router 306*a*-1, a second primary service provider network router 306*a*-2, a first secondary service provider network router 306*b*-1, and/or a second secondary service provider network router 306*b*-2.

According to some embodiments, the application delivery controller cluster 322 may be insulated and/or protected from the production network 304*c* by an external firewall cluster 308*a*. The first user device 302*a* may, for example, be required to provide credentials to and/or otherwise access the application delivery controller cluster 322 via the external firewall cluster 308*a*.

In some embodiments, the application delivery controller cluster 322 may receive via and/or from the external firewall cluster 308*a* and/or the production network 304*c*, one or more requests, calls, transmissions, and/or commands from the first user device 302*a*. The first user device 302*a* may, for example, submit a call for an online gaming interface to the application delivery controller cluster 322. In some embodiments, the application delivery controller cluster 322 may comprise one or more hardware, software, and/or firmware devices and/or modules configured (e.g., specially-programmed) to route events and/or responses between the first user device 302*a* and one or more of the servers 310*a-g*. In the case that the first user device 302*a* is utilized to access an online gaming interface (not explicitly shown; such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein) for example, one or more of the web servers 310*a* (e.g., that may provide graphical and/or rendering elements for an interface and/or other web services) and/or the application servers 310*b* (e.g., that may provide rule and/or logic-based programming routines, elements, and/or functions—e.g., game play engines) may be called and/or managed by the application delivery controller cluster 322.

In some embodiments, the messaging broker servers 310*c* may receive and/or retrieve messages from the first user device 302*a* (and/or from one or more of the other servers 310*a-b*, 310*d-g*) and perform one or more inter-application processes in relation thereto. The messaging broker servers 310*c* may, for example, route, transform, consolidate, aggregate, store, augment, and/or otherwise process one or more requests in connection with provision of online gaming services to the first user device 302*a* (e.g., facilitating a decoupling of services provided by various applications on and/or from the various servers 310*a-b*, 310*d-g*). According to some embodiments, the game broadcaster servers 310*d* may provide scheduled releases of information descriptive of an online game. The game broadcaster servers 310*d* may, for example, provide a broadcast feed of bingo numbers, slot and/or other random (and/or pseudo-random) number results that may be accessed by (and/or transmitted to) the first user device 302*a* (e.g., in connection with the play of an online bingo, slots, and/or other game for which broadcast information may be utilized). In some embodiments, the chat servers 310*e* may provide, manage, and/or facilitate communications between the first user device 302*a* (and/or first user thereof) and one or more other player/user devices (such as a second user device 302*b* and/or other player/user devices not shown in FIG. 3).

According to some embodiments, the second user device 302*b* may generally comprise an electronic device owned and/or operated by a user (not shown) closely affiliated with an entity that operates the system 300 (such entity also not shown). An employee (e.g., programmer and/or Customer Service Representative (CSR)), contractor, and/or other agent of an online game provider may, for example, utilize the second user device 302*b* to interface with the privately-accessible VPN 304*d*. The VPN 304*d* may, for example, provide direct access to the application servers 310*b*, the database servers 310*f*, the management and monitoring servers 310*g*, and/or the application delivery controller cluster 322. In some embodiments (as depicted in FIG. 3), such access may be gated through and/or insulated or protected by an internal firewall cluster 308*b*. The second user device 302*b* may, for example, be required to provide credentials to and/or otherwise access the application delivery controller cluster 322 and/or servers 310*a-g* via the internal firewall cluster 308*b*.

In some embodiments, the database servers 310*f* may provide access to one or more databases and/or data stores (e.g., not shown in FIG. 3; for data storage and/or retrieval). In some embodiments, the management and monitoring servers 310*g* may provide services such as monitoring, reporting, troubleshooting, analysis, configuring, etc. to the second user device 302*b*. The second user device 302*b* may, for example, access the management and monitoring servers 310*g* and/or the database servers 310*f* to run reports descriptive of online gaming operations, game play, and/or game referral setup, management, and/or analysis. According to some embodiments, either or both of the user devices 302*a-b* in conjunction with one or more of the servers 310*a-g* and/or the application delivery controller cluster 322 may conduct (in whole or in part), facilitate, and/or otherwise be associated with execution of one or more stored procedures, applications, processes, and/or methods (e.g., the methods 600, 800, 1000, 1200, 1400 of FIG. 6, FIG. 8, FIG. 10, FIG. 12, and/or FIG. 14 herein, and/or one or more portions and/or combinations thereof) as described herein.

Utilization of the term "server" with respect to the servers 310*a-g* of the system 300 of FIG. 3 is meant solely to ease description of the configuration and/or functionality of the servers 310*a-g*. The term "server" is not intended to be limiting with respect to any particular hardware, software, firmware, and/or quantities thereof utilized to implement any or all of the servers 310*a-g* of the system 300. Similarly, while multiple types and/or instances of the severs 310*a-g* are depicted in FIG. 3, any or all of the servers 310*a-g* may be implemented in, on, and/or by one or multiple computer server and/or other electronic devices.

Figure 4:
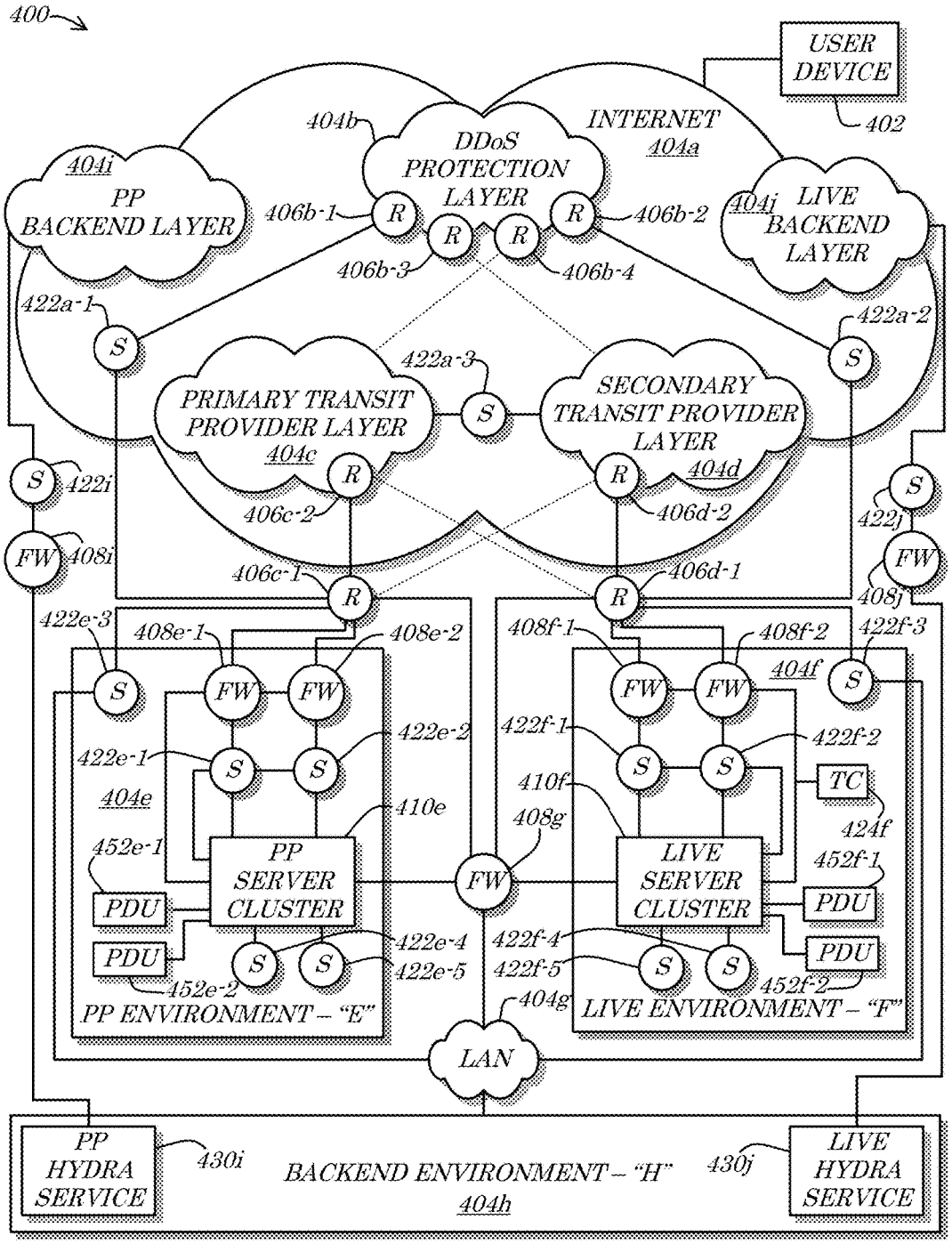
FIG. 4 is a block diagram of a system according to some embodiments.

Referring now to FIG. 4, a block diagram of a system 400 according to some embodiments is shown. In some embodiments, the system 400 may comprise and/or define a "front-end" architecture of a gaming platform such as a platform via which social, single-player, multiplayer, and/or online games may be played (e.g., one or more slot-style games as described herein). The system 400 may be similar in configuration and/or functionality, for example, to the system 300 of FIG. 3 and/or one or more portions thereof. In some embodiments, the system 400 may comprise a user device 402, a plurality of networks (and/or environments and/or layers) 404*a-j* (e.g., the Internet 404*a*, a Distributed Denial-of-Service (DDoS) protection layer 404*b*, a primary transit provider layer 404*c*, a secondary transit provider layer 404*d*, a Pre-Production (PP) environment 404*e*, a live environment 404*f*, a LAN 404*g*, a backend environment 404*h*, a PP backend layer 404*i*, and/or a live backend layer 404*j*), a plurality of routers 406*b-d*, a plurality of firewall devices 408*e-g*, 408*i-j*, a plurality of servers 410*e-f* (e.g., a PP server cluster 410*e* and/or a live server cluster 410*f*), a plurality of switching devices 422*a*, 422*e-f*, 422*i-j*, a Terminal Concentrator (TC) 424*f*, a plurality of "hydra" services 430*i-j* (e.g., a PP hydra service 430*i* and/or a live hydra service 430*j*), and/or a plurality of Power Distribution Unit (PDU) devices 452*e-f*.

According to some embodiments, any or all of the components 402, 404*a-j*, 406*b-d*, 408*e-g*, 408*i-j*, 410*e-f*, 422*a*, 422*e-f*, 422*i-j*, 424*f*, 430*i-j*, 452*e-f* of the system 400 may be similar in configuration and/or functionality to any similarly named and/or numbered components described herein. Fewer or more components 402, 404*a-j*, 406*b-d*, 408*e-g*, 408*i-j*, 410*e-f*, 422*a*, 422*e-f*, 422*i-j*, 424*f*, 430*i-j*, 452*e-f* (and/or portions thereof) and/or various configurations of the components 402, 404*a-j*, 406*b-d*, 408*e-g*, 408*i-j*, 410*e-f*, 422*a*, 422*e-f*, 422*i-j*, 424*f*, 430*i-j*, 452*e-f* may be included in the system 400 without deviating from the scope of embodiments described herein. While multiple instances of some components 404*a-j*, 406*b-d*, 408*e-g*, 408*i-j*, 410*e-f*, 422*a*, 422*e-f*, 422*i-j*, 430*i-j*, 452*e-f* are depicted and while single instances of other components 402, 424*f* are depicted, for example, any component 402, 404*a-j*, 406*b-d*, 408*e-g*, 408*i-j*, 410*e-f*, 422*a*, 422*e-f*, 422*i-j*, 424*f*, 430*i-j*, 452*e-f* depicted in the system 400 may comprise a single device, a combination of devices and/or components 402, 404*a-j*, 406*b-d*, 408*e-g*, 408*i-j*, 410*e-f*, 422*a*, 422*e-f*, 422*i-j*, 424*f*, 430*i-j*, 452*e-f*, and/or a plurality of devices, as is or becomes desirable and/or practicable. Similarly, in some embodiments, one or more of the various components 402, 404*a-j*, 406*b-d*, 408*e-g*, 408*i-j*, 410*e-f*, 422*a*, 422*e-f*, 422*i-j*, 424*f*, 430*i-j*, 452*e-f* may not be needed and/or desired in the system 400.

In some embodiments, the user device 402 may be utilized to access one or more of the PP environment 404*e*, the live environment 404*f*, and/or the backend environment 404*h* via the Internet 404*a*. In some embodiments, the user device 402 may be utilized to access the backend environment 404*h* and/or the PP hydra service 430*i* via the PP backend layer 404*i*. A PP backend switch device 422*i* and/or a PP backend firewall device 408*i* may, for example, gate and/or control access to the backend environment 404*h* and/or the PP hydra service 430*i*, via the PP backend layer 404*i*. In some embodiments, the user device 402 may be utilized to access the backend environment 404*h* and/or the live hydra service 430*j* via the live backend layer 404*j*. A live backend switch device 422*j* and/or a live backend firewall device 408*j* may, for example, gate and/or control access to the backend environment 404*h* and/or the live hydra service 430*j*, via the live backend layer 404*j*.

According to some embodiments, any communications (e.g., requests, calls, and/or messages) from the user device 402 may be passed through the DDoS protection layer 404*b*. The DDoS protection layer 404*b* may, for example, monitor and/or facilitate protection against various forms of cyber attacks including, but not limited to, DDoS attacks. In some embodiments, the DDoS protection layer 404*b* may comprise and/or be in communication with a plurality of DDoS router devices 406*b*-1, 406*b*-2, 406*b*-3, 406*b*-4 that may be utilized to route and/or direct incoming communications (e.g., from the user device 402) to appropriate portions of the system 400.

In some embodiments, the DDoS protection layer 404*b* and/or a first DDoS router device 406*b*-1 may route communications from the user device 402 through and/or via a first switch device 422*a*-1 and/or to, through, and/or via a first primary transit provider router device 406*c*-1. In some embodiments, the first switch device 422*a*-1 may comprise a device utilized for security switching such as may implement communications in accordance with the Generic Routing Encapsulation (GRE) communications tunneling protocol described in RFC 2784 "Generic Routing Encapsulation (GRE)" published by the Network Working Group (NWG) in March, 2000. The first primary transit provider router device 406*c*-1 may, for example, provide access to the PP environment 404*e* and/or the PP server cluster 410*e* thereof, such as via one or more PP firewall devices 408*e*-1, 408*e*-2 and/or one or more PP switch devices 422*e*-1, 422*e*-2. According to some embodiments, the PP switch devices 422*e*-1, 422*e*-2 may comprise content switching devices that process and route data (e.g., in the data link layer) based on data content. In some embodiments, the first primary transit provider router device 406*c*-1 may direct communications to, through, and/or via a PP LAN switch device 422*e*-3 that provides and/or facilitates access to the LAN 404*g*. The LAN 404*g* may, for example, provide private access to and/or between the PP environment 404*e*, the live environment 404*f*, and/or the backend environment 404*h*. In some embodiments, the first primary transit provider router device 406*c*-1 and/or the PP LAN switch device 422*e*-3 may direct communications to, through, and/or via a LAN firewall device 408*g* that provides direct access to either or both of the PP server cluster 410*e* and the live server cluster 410*f*.

According to some embodiments, the DDoS protection layer 404*b* and/or a second DDoS router device 406*b*-2 may route communications from the user device 402 through and/or via a second switch device 422*a*-2 and/or to, through, and/or via a first secondary transit provider router device 406*d*-1. In some embodiments, the second switch device 422*a*-2 may comprise a device utilized for security switching such as may implement communications in accordance with the GRE communications tunneling protocol. The first secondary transit provider router device 406*d*-1 may, for example, provide access to the live environment 404*f* and/or the live server cluster 410*f* thereof, such as via one or more live firewall devices 408*f*-1, 408*f*-2 and/or one or more live switch devices 422*f*-1, 422*f*-2. According to some embodiments, the live switch devices 422*f*-1, 422*f*-2 may comprise content switching devices that process and route data (e.g., in the data link layer) based on data content. In some embodiments, the first secondary transit provider router device 406*d*-1 may direct communications to, through, and/or via a live LAN switch device 422*f*-3 that provides and/or facilitates access to the LAN 404*g*. In some embodiments, the first secondary transit provider router device 406*d*-1 and/or the live LAN switch device 422*f*-3 may direct communications to, through, and/or via the LAN firewall device 408*g* that provides direct access to either or both of the PP server cluster 410*e* and the live server cluster 410*f*.

In some embodiments, the DDoS protection layer 404*b* and/or one or more of a third DDoS router device 406*b*-3 and/or a fourth DDoS router device 406*b*-4 may route communications from the user device 402 through and/or via one or more of the primary transit provider layer 404*c* and/or the secondary transit provider layer 404*d*. In some embodiments, a transit provider switch device 422*a*-3 may direct, swap, route, and/or manage communications between the primary transit provider layer 404*c* and the secondary transit provider layer 404*d*. According to some embodiments, the transit provider switch device 422*a*-3 may comprise a switching device that operates in accordance with an Exterior Border Gateway Protocol (EBGP)—e.g., the transit provider switch device 422*a*-3 may comprise one or more edge or border routers. In some embodiments, the first primary transit provider router device 406*c*-1, the first secondary transit provider router device 406*d*-1, a second primary transit provider router device 406*c*-2, and/or a second secondary transit provider router device 406*d*-2 may be utilized to route and/or direct communications between (i) the primary transit provider layer 404*c* and/or the secondary transit provider layer 404*d* and (ii) the PP environment 404*e* and/or the live environment 404*f*.

Figure 15A:
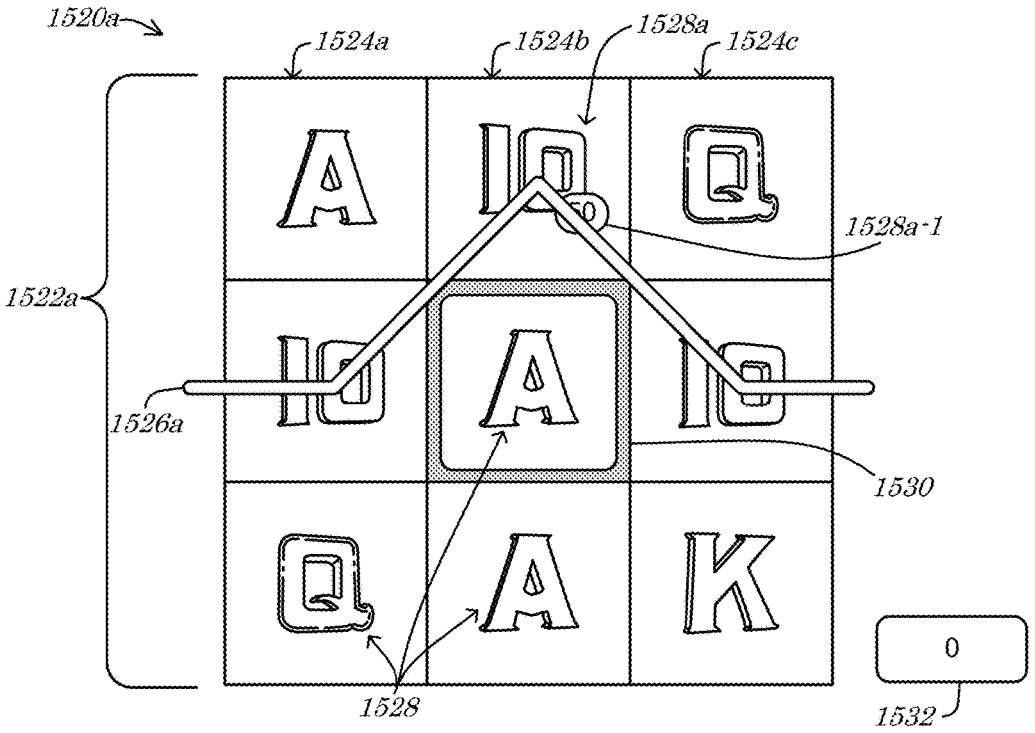
FIG. 15A, FIG. 15B, FIG. 15C, and FIG. 15D are diagrams of example slot-style interfaces according to some embodiments.
Figure 15B:
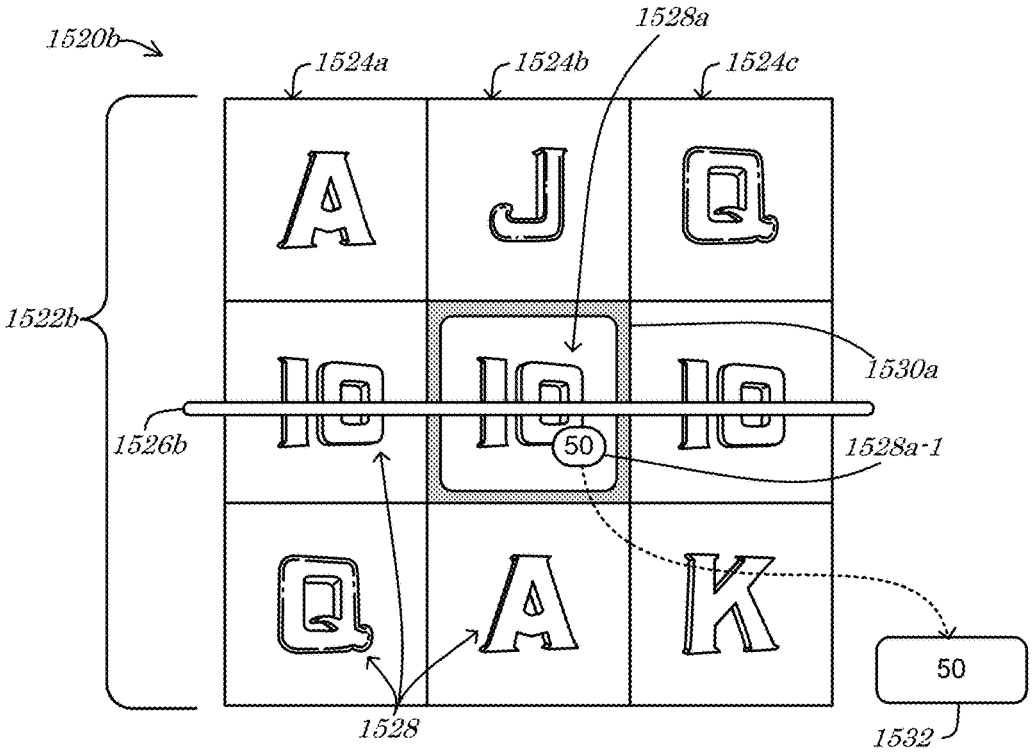
Figure 15C:
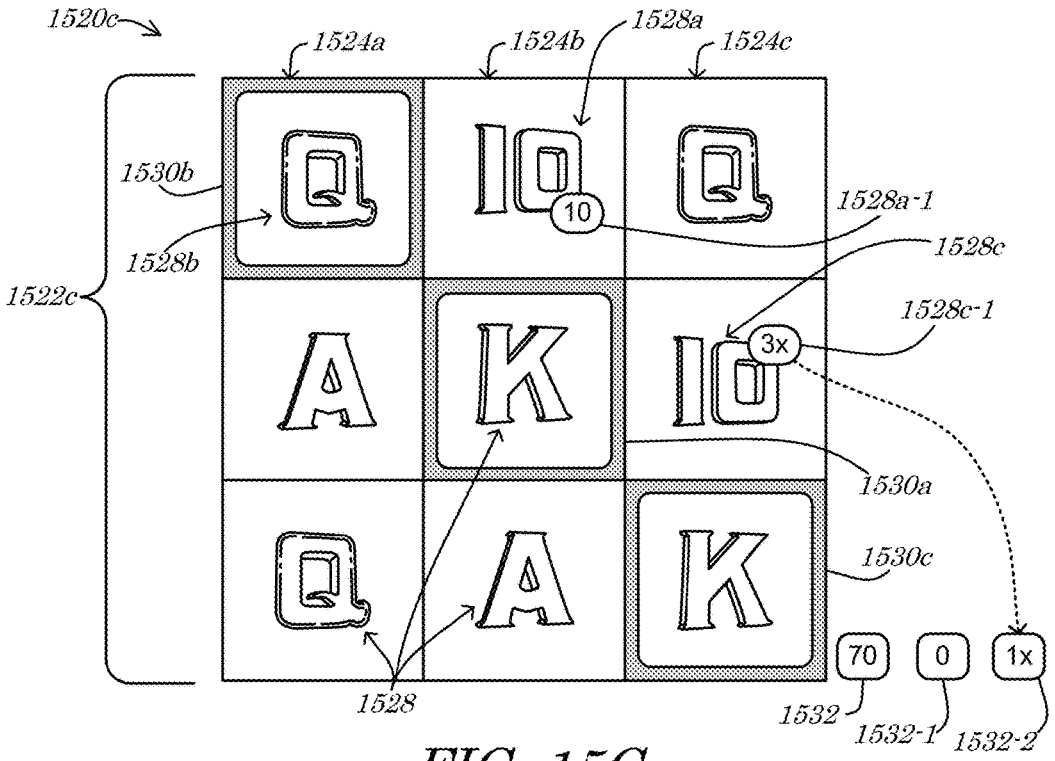
Figure 15D:
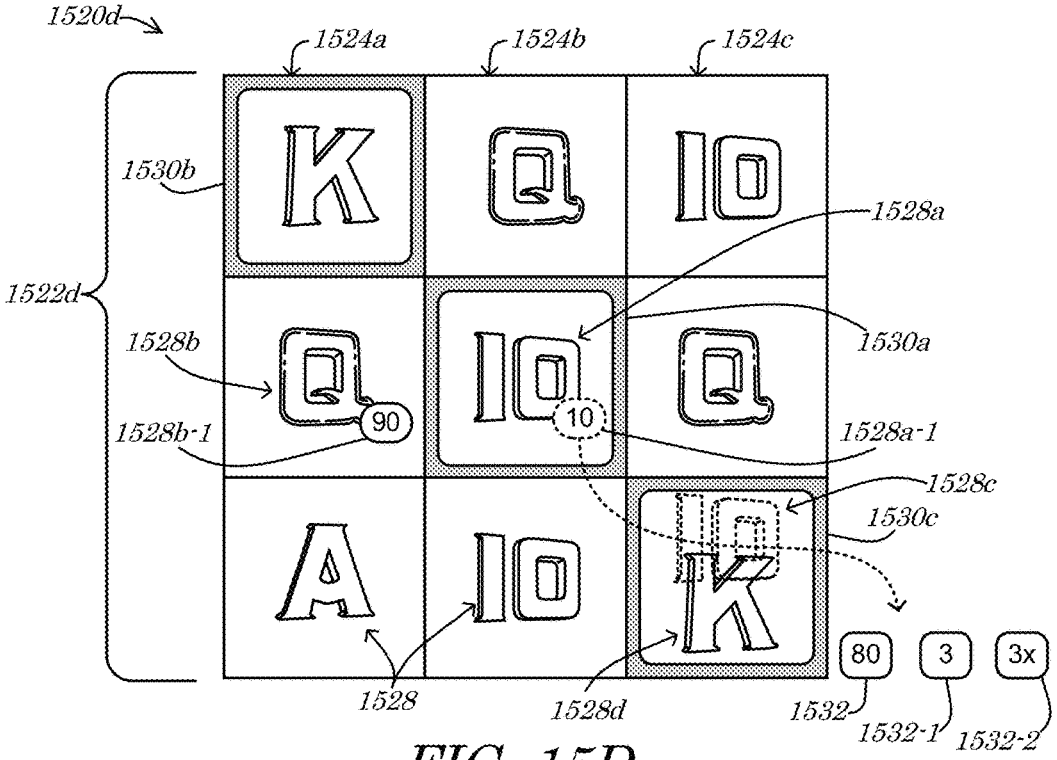
Figure 16:
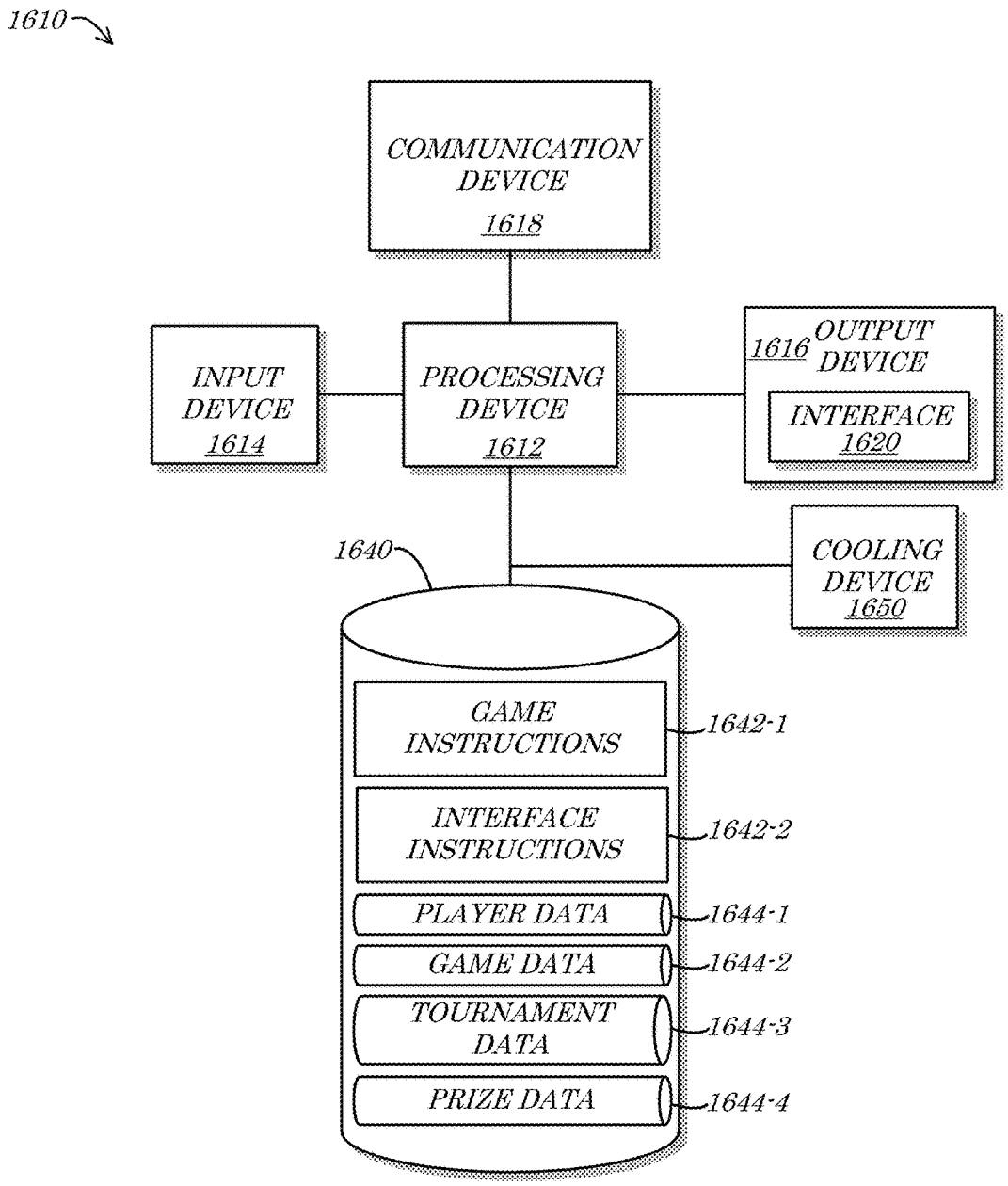
FIG. 16 is a block diagram of an apparatus according to some embodiments.
Figure 17A:
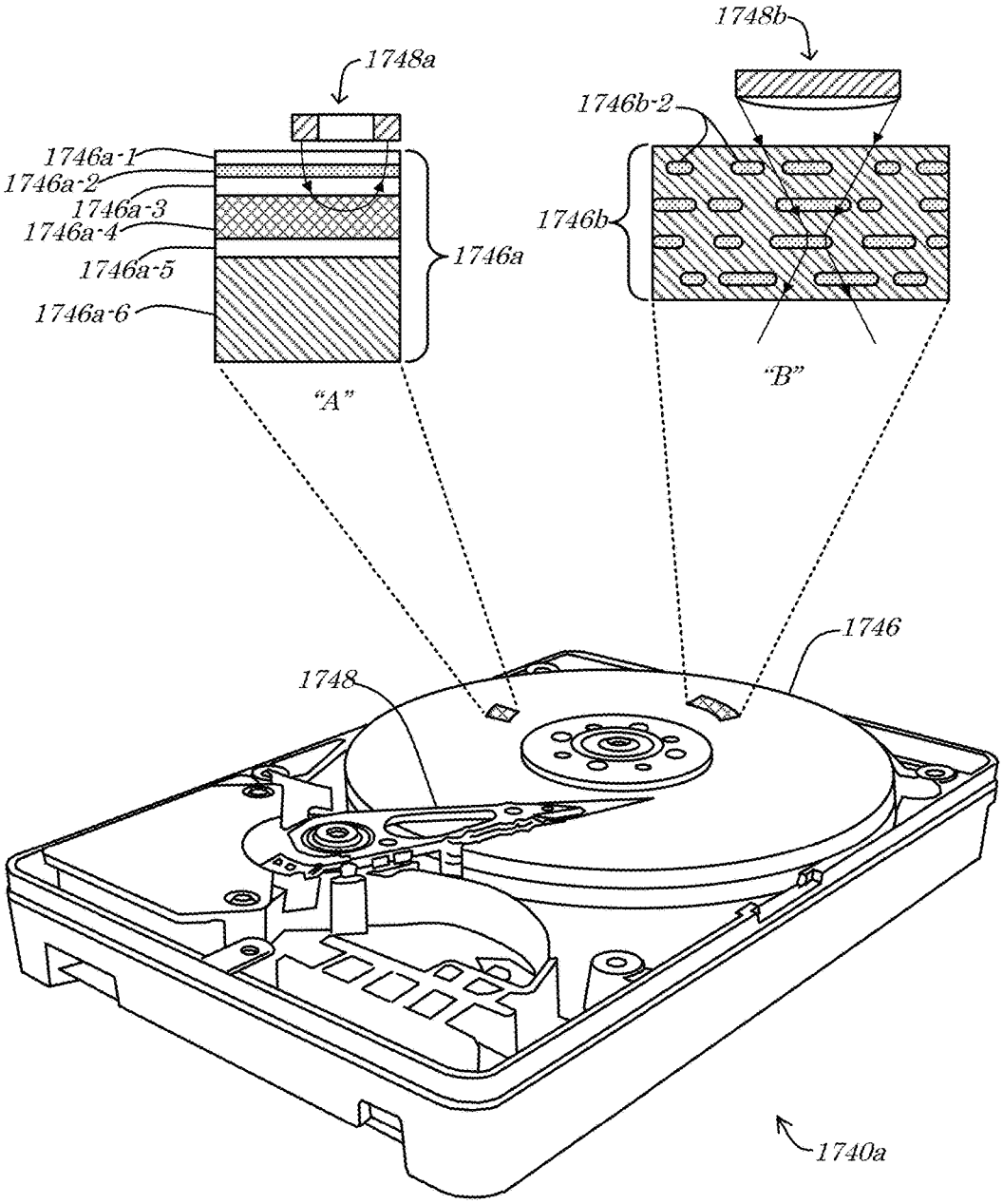
FIG. 17A, FIG. 17B, FIG. 17C, FIG. 17D, and FIG. 17E are perspective diagrams of exemplary data storage devices according to some embodiments.
Figure 17B:
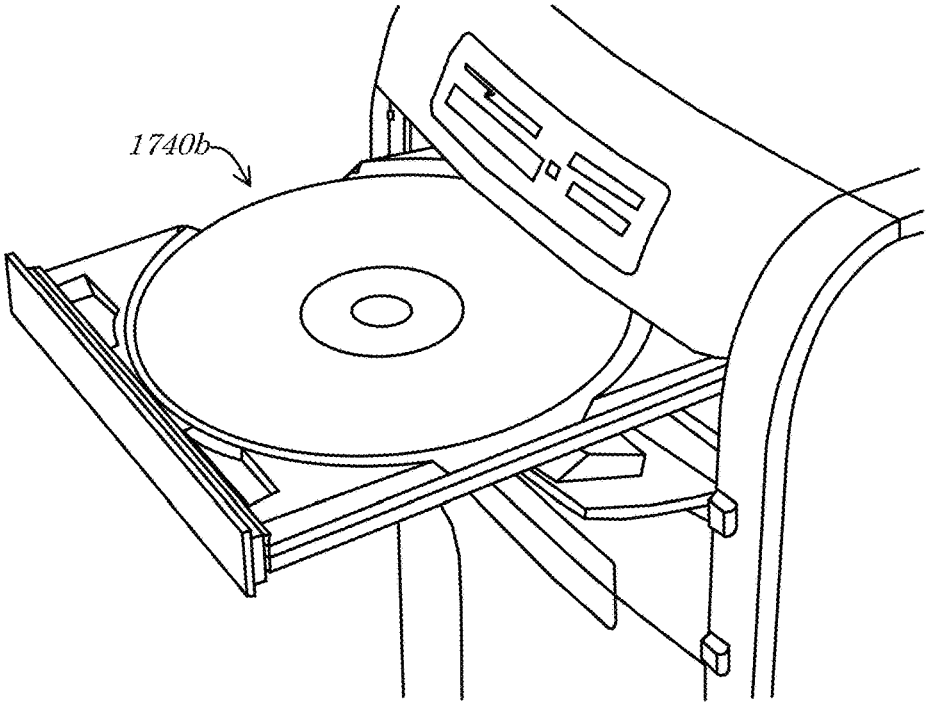
Figure 17C:
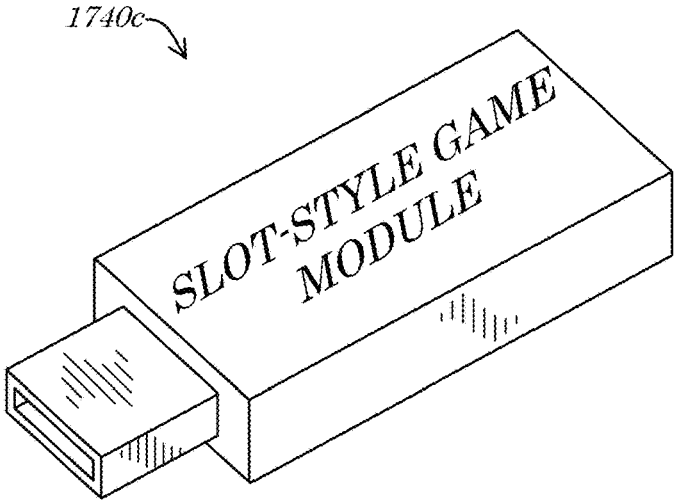
Figure 17D:
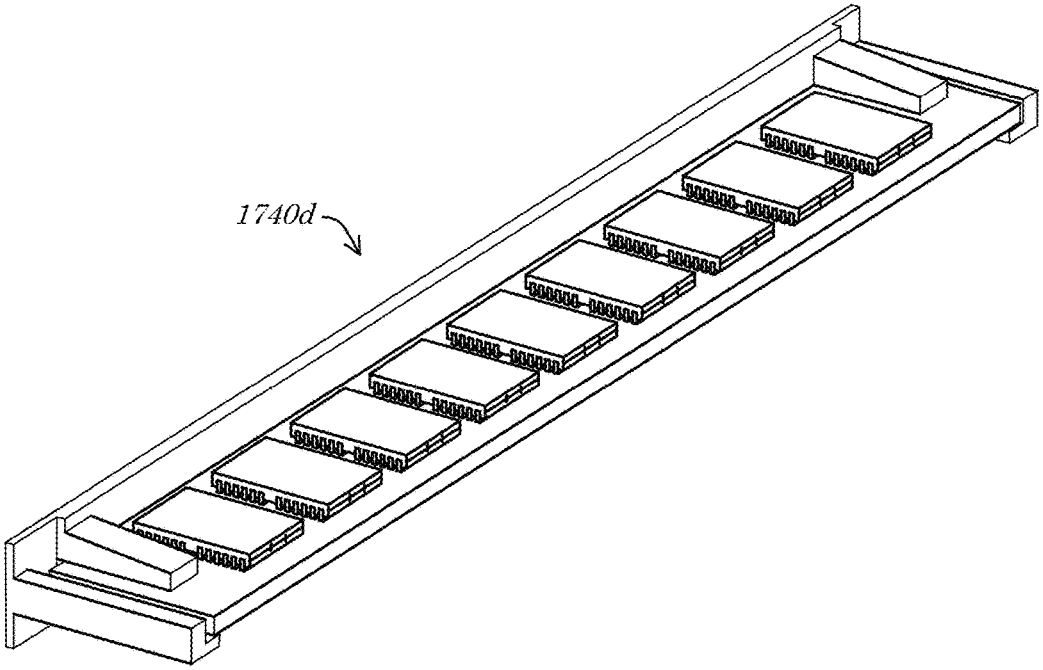
Figure 17E:
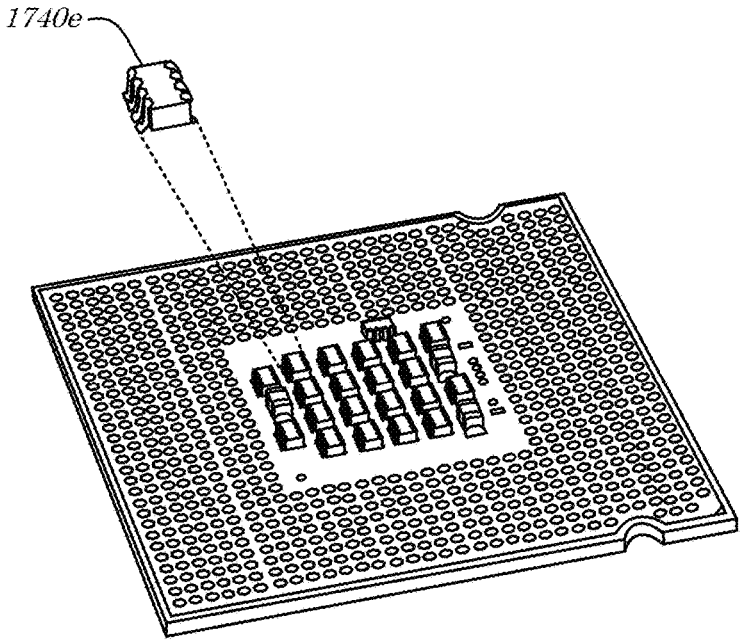

According to some embodiments, the PP server cluster 410*e* and/or the PP environment 404*e* may comprise various hardware, software, and/or firmware that permits a user (e.g., of the user device 402) to program, edit, manage, and/or otherwise interface with PP game elements and/or interfaces (e.g., for development and/or testing purposes; such as to define one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein). In some embodiments, the PDU devices 452*e*-1, 452*e*-2 may generally provide power distribution, supply, management, backup, and/or conditioning services (e.g., to the PP server cluster 410*e*) as is or becomes desired. According to some embodiments, additional switch devices 422*e*-4, 422*e*-5 may be utilized to distribute, balance, manage and/or control communications to, from, and/or within the PP server cluster 410*e*.

In some embodiments, the live server cluster 410*f* and/or the live environment 404*f* may comprise various hardware, software, and/or firmware that permits a user (e.g., of the user device 402) to program, edit, manage, and/or otherwise interface with live game elements and/or interfaces (e.g., for troubleshooting, corrective, and/or live environment management purposes; such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein). In some embodiments, the PDU devices 452*f*-1, 452*f*-2 may generally provide power distribution, supply, management, backup, and/or conditioning services (e.g., to the live server cluster 410*f*) as is or becomes desired. According to some embodiments, additional switch devices 422*f*-4, 422*f*-5 may be utilized to distribute, balance, manage and/or control communications to, from, and/or within the live server cluster 410*f*. In some embodiments, the TC device 424*f* may be utilized to manage communications from a variety of data sources such as by providing communication capability between various communications channels (not separately depicted in FIG. 4).

According to some embodiments, the user device 402 in conjunction with the live server cluster 410*f* (e.g., via the Internet 404*a*) may conduct (in whole or in part), facilitate, and/or otherwise be associated with execution of one or more stored procedures, applications, processes, and/or methods (e.g., the methods 600, 800, 1000, 1200, 1400 of FIG. 6, FIG. 8, FIG. 10, FIG. 12, and/or FIG. 14 herein, and/or one or more portions and/or combinations thereof) as described herein.

Figure 5:
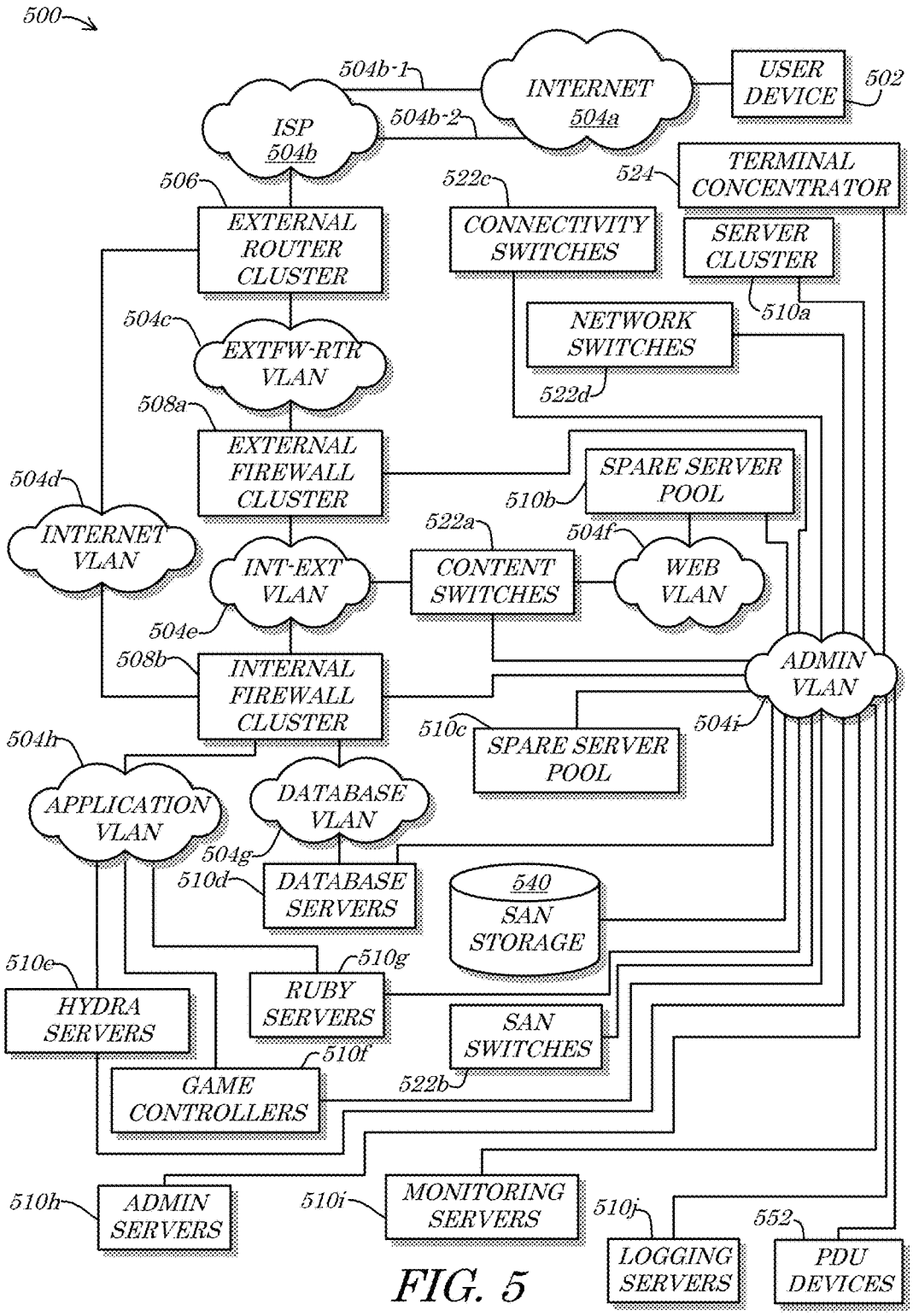
FIG. 5 is a block diagram of a system according to some embodiments.

Turning to FIG. 5, a block diagram of a system 500 according to some embodiments is shown. In some embodiments, the system 500 may comprise and/or define a "backend" architecture of a gaming platform such as a platform via which social, single-player, multiplayer, and/or online games may be played (e.g., one or more slot-style games as described herein). The system 500 may be utilized in conjunction with the systems 300, 400 if FIG. 3 and/or FIG. 4 herein, for example, and/or may be similar in configuration and/or functionality to the backend environment 404*h* of the system 400 of FIG. 4. In some embodiments, the system 500 may comprise a user device 502, a plurality of networks (and/or environments and/or layers) 504*a-i* (e.g., the Internet 504*a*, an ISP 504*b*, an External Firewall-Router (EXTFW-RTR) Virtual LAN (VLAN) 504*c*, an Internet VLAN 504*d*, an Internal-External (INT-EXT) VLAN 504*e*, a web VLAN 504*f*, a database VLAN 504*g*, an application VLAN 504*h*, and/or an administrator VLAN 504*i*), an external router cluster 506, a plurality of firewall clusters 508*a-b* (e.g., an external firewall cluster 508*a* and/or an internal firewall cluster 508*b*), a plurality of servers 510*a-j* (e.g., a server cluster 510*a*, a first spare server pool 510*b*, a second spare server pool 510*c*, database servers 510*d*, "hydra" servers 510*e*, game controllers 510*f*, ruby servers 510*g*, admin servers 510*h*, monitoring servers 510*i*, and/or logging servers 510*j*), a plurality of switches 522*a-d* (e.g., content switches 522*a*, Storage Area Network (SAN) switches 522*b*, connectivity switches 522*c*, and/or network switches 522*d*), a TC device 524, a SAN storage device 540, and/or one or more PDU devices 552.

According to some embodiments, any or all of the components 502, 504*a-l*, 506, 508*a-b*, 510*a-j*, 522*a-d*, 524, 540, 552 of the system 500 may be similar in configuration and/or functionality to any similarly named and/or numbered components described herein. Fewer or more components 502, 504*a-l*, 506, 508*a-b*, 510*a-j*, 522*a-d*, 524, 540, 552 (and/or portions thereof) and/or various configurations of the components 502, 504*a-l*, 506, 508*a-b*, 510*a-j*, 522*a-d*, 524, 540, 552 may be included in the system 500 without deviating from the scope of embodiments described herein. While multiple instances of some components 504*a-l*, 508*a-b*, 510*a-j*, 522*a-d* are depicted and while single instances of other components 502, 506, 524, 540, 552 are depicted, for example, any component 502, 504*a*-1, 506, 508*a-b*, 510*a-j*, 522*a-d*, 524, 540, 552 depicted in the system 500 may comprise a single device, a combination of devices and/or components 502, 504*a-l*, 506, 508*a-b*, 510*a-j*, 522*a-d*, 524, 540, 552, and/or a plurality of devices, as is or becomes desirable and/or practicable. Similarly, in some embodiments, one or more of the various components 502, 504*a-l*, 506, 508*a-b*, 510*a-j*, 522*a-d*, 524, 540, 552 may not be needed and/or desired in the system 500.

In some embodiments, the user device 502 may be utilized to access and/or interface with one or more of the servers 510*a-j* via the Internet 504*a*. In some embodiments, the Internet 502*a* may be linked to the ISP 504*b* via multiple (e.g., redundant) connectivity paths 504*b*-1, 504*b*-2 (e.g., for load balancing, security, and/or failure recovery). According to some embodiments, the ISP 504*b* may be in communication with (and/or comprise) the external router cluster 506. The external router cluster 506 may route certain requests, calls, and/or transmissions (and/or users—e.g., based on credentials and/or other information) through the EXTFW-RTR VLAN 504*c* and/or through the external firewall cluster 508*a*, for example, and/or may route certain requests, calls, and/or transmissions (and/or users—e.g., based on credentials and/or other information) through the Internet VLAN 504*d* and/or through the internal firewall cluster 508*b*.

In the case that a user (not shown) of the user device 502 comprises an online game player, consumer, and/or other member of the public, for example, the external router cluster 506 may direct communications through the EXTFW-RTR VLAN 504*c* and/or through the external firewall cluster 508*a*. In the case that the user of the user device 502 comprises a programmer, tester, employee, and/or other agent of a game provider and/or other entity that operates the system 500, for example, the external router cluster 506 may direct communications through the Internet VLAN 504*d* and/or through the internal firewall cluster 508*b*. In some embodiments, access via either or both of the external firewall cluster 508*a* and/or the internal firewall cluster 508*b* may permit the user device 502 to communicate via the INT-EXT VLAN 504*e*. The INT-EXT VLAN 504*e* may, for example, provide access to the content switches 522*a* which may, in some embodiments, serve content from any or all of the servers 510*a-j* to the user device 502, as is or becomes appropriate or desired. In some embodiments, the content switches 522*a* may communicate with the first spare server pool 510*b* via the web LAN 504*f*.

According to some embodiments, private and/or other specialized access to the system 500 via the internal firewall cluster 508*b* may permit the user device 502 to communicate via one or more of the database VLAN 504*g*, the application VLAN 504*h*, and/or the admin VLAN 504*i*. The database VLAN 504*g* may be utilized, for example, to access and/or communicate with the database servers 510*d*. In some embodiments, the application VLAN 504*h* may be utilized to access and/or communicate with any or all of the hydra servers 510*e*, the game controllers 510*f*, and/or the ruby servers 510*g*.

The admin VLAN 504*i* may allow, promote, conduct, facilitate, and/or manage a wide variety of communications within the system 500. The admin VLAN 504*i* may, for example, communicatively connect and/or couple any or all of the firewalls 508*a-b*, the servers 510*a-j*, the switches 522*a-d*, the TC device 524, the SAN storage 540, and/or the PDU devices 552. The user device 502 may be utilized, in conjunction with the admin servers 510*h* and/or via the admin VLAN 504*i* for example, to define, edit, adjust, manage, and/or otherwise access settings (and/or data) of the firewalls 508*a-b*, any or all of the switches 522*a-d*, the TC device 524, and/or the PDU devices 552. In some embodiments, the user device 502 (and/or the admin servers 510*h*) may be utilized to manage and/or access content, rules, settings, and/or performance characteristics or preferences for any or all of the servers 510*a-j*.

In some embodiments, the server cluster 510*a* may comprise one or more servers and/or other electronic controller devices (e.g., blade servers) configured to provide online gaming data (e.g., interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein), outcomes, and/or results) to the user device 502. According to some embodiments, the first spare server pool 510*b* and/or the second spare server pool 510*c* may comprise one or more server and/or other electronic controller devices configured to supplement and/or replace the server cluster 510*a* as needed and/or desired (e.g., to manage load and/or error recovery situations). In some embodiments, the database servers 510*c* may provide and/or manage access to stored data such as data stored in and/or by the SAN storage device 540. In some embodiments, the hydra servers 510*e* and/or the game controllers 510*f* may provide online game information such as interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein), results, graphics, sounds, and/or other media to the user device 502 (e.g., via the application VLAN 504*h*). In some embodiments, the ruby servers 510*g* may comprise one or more processing devices configured to provide access to one or more programming languages (e.g., "Ruby") and/or Application Programming Interface (API) mechanisms via which the servers 510*a-j* and/or other portions of the system 500 may be configured to operate (e.g., in accordance with specially and/or pre-programmed instructions written in the programming language and/or developed by the API provided by the ruby servers 510*g*). According to some embodiments, the admin servers 510*h*, the monitoring servers 510*i*, and/or the logging servers 510*j* may be utilized and/or configured to provide administrative, parameter and/or metric monitoring and/or reporting, and/or data logging and/or audit services, respectively.

According to some embodiments, the user device 502 in conjunction with one or more of the servers 510*a-j* (e.g., via the Internet 504*a*) may conduct (in whole or in part), facilitate, and/or otherwise be associated with execution of one or more stored procedures, applications, processes, and/or methods (e.g., the methods 600, 800, 1000, 1200, 1400 of FIG. 6, FIG. 8, FIG. 10, FIG. 12, and/or FIG. 14 herein, and/or one or more portions and/or combinations thereof) as described herein.

IV. Methods and Interfaces

Figure 6:
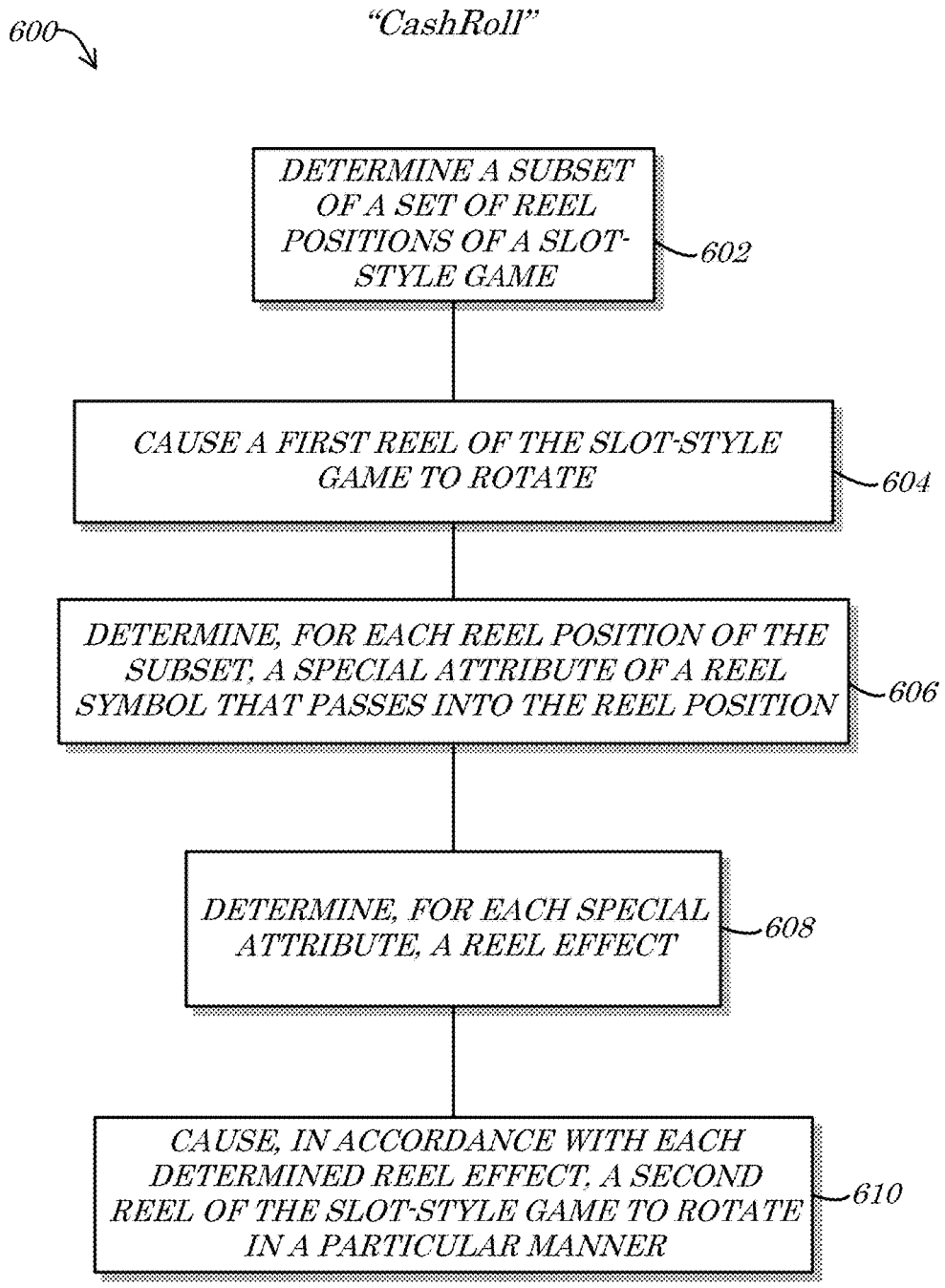
FIG. 6 is a flow diagram of a method according to some embodiments.

Referring now to FIG. 6, a flow diagram of a method 600 according to some embodiments is shown. In some embodiments, the method 600 may be descriptive of and/or result in an instance of a particular type or style of game such as a slot-style game titled "Cash Roll", as depicted. According to some embodiments, the method 600 may be performed and/or implemented by and/or otherwise associated with one or more specialized and/or computerized processing devices (e.g., the player and/or user devices 102*a-n*, 202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein), specialized computers, computer terminals, computer servers, computer systems and/or networks, and/or any combinations thereof (e.g., by one or more online game providers and/or online gaming player processing devices). In some embodiments, the method 600 may be embodied in, facilitated by, and/or otherwise associated with various input mechanisms and/or interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein).

The process and/or flow diagrams described herein do not necessarily imply a fixed order to any depicted actions, steps, and/or procedures, and embodiments may generally be performed in any order that is practicable unless otherwise and specifically noted. While generally limiting with respect to order and/or timing, in some embodiments, the presented methods and processes may be specifically limited to and/or structured in accordance with any depicted and/or described order, hierarchy, timing, etc. Any of the processes and/or methods described herein may be performed and/or facilitated by hardware, software (including microcode), firmware, or any combination thereof. For example, a storage medium (e.g., a hard disk, Universal Serial Bus (USB) mass storage device, and/or Digital Video Disk (DVD)) may store thereon instructions that when executed by a machine (such as a computerized processing device) result in performance according to any one or more of the embodiments described herein. According to some embodiments, performance and/or execution of the methods herein may only be practicably effectuated by an electronic processing device. In the case that thousands of online game players are simultaneously participating on online gaming sessions, some or all of which are conducted in accordance with embodiments described herein for example, execution of particular gaming-related methods and/or processes may only be possible if conducted by a computerized device that has been specially-programmed to automatically execute thousands of commands or instructions (to effectuate disclosed embodiments) per second. In other words, any particular step or portion of a disclosed method or process may, in some embodiments, be conducted hundreds or thousands of times per minute or per second.

In some embodiments, the method 600 may comprise determining (e.g., by a processing device) a subset of a set of reel positions of a slot-style game, at 602. The number and/or positioning of the subset of reel (e.g., matrix) positions may be determined randomly, for example, and/or may be at least partially based on player input (e.g., a player may select and the processing device may receive an indication of a player selection of one or more reel positions in a provided game matrix) and/or earned or purchased capabilities or achievements. In some embodiments, each position of the subset of reel positions may be highlighted, framed, bracketed, "popped-out", recessed, and/or otherwise graphically altered and/or showcased to indicate to a player which reel positions have been determined and/or selected. In some embodiments, a single and/or central position of the reel(s) of a slot-style game may comprise the subset.

According to some embodiments, the method 600 may comprise causing (e.g., by the processing device), after the determining of the subset, at least a first reel of the slot-style game to rotate, at 604. Once the subset of reel positions is selected and/or highlighted, for example, one or more reels associated with and/or comprising the positions may be "spun", rotated, cycled, and/or otherwise progressed in a manner similar to normal slot-style game play (i.e., a first matrix of game symbols may be progressed to define a second, subsequent matrix of game symbols in one or more automatic and/or predetermined manners—the terms "rotate" and "spin" are utilized for convenience and are not intended to be limiting with respect to the manner in which the slot-style game progresses). In some embodiments, however, the spinning of the reel(s) may be conducted at a speed slower than a normal speed of the reels. In some embodiments, the reels may be spun in a "nudge" manner such that the reel progresses a single position at a time, with a substantial (e.g., single second or multi-second) pause in between progressions. In such a manner, for example, instead of the typical scenarios where reel symbols spin past or through matrix positions quickly, rendering a blurred visual effect, certain reels may, at certain times, be progressed or transitioned slowly (at least temporarily) such that individual reel symbols that pass into or through matrix positions (or a particular matrix position) on the reel are readily visible and/or identifiable to a player to whom output of the progression is provided).

In some embodiments, the method 600 may comprise determining (e.g., by the processing device), for each reel position of the subset, a special attribute of a reel symbol that passes into (or through or out of) the reel position, at 606. In some embodiments, the special attribute may comprise a "sub-symbol"—e.g., a secondary indicator (such as a graphical feature) of the symbol. In some embodiments, the special attribute may be distinct from the reel symbol itself. In other words, while certain reel symbols populated and/or progressed based on primary game play mechanics and/or rules may cause certain game events to occur (e.g., a "wild" symbol may have a particular effect on game play, such as enhancing the probability of a winning outcome), the special attribute may be affixed and/or assigned to any type of reel symbol and may not effect or alter any standard functionality attributed to a particular reel symbol type (e.g., a "wild" symbol may still function as a wild symbol regardless of whether it is associated with a special attribute).

According to some embodiments, the method 600 may comprise determining (e.g., by the processing device), for each determined special attribute of the reel symbols that pass into (or through or out of) a reel position of the subset, a reel effect assigned to the special attribute, at 608. Each special attribute (e.g., sub-symbol) may be associated, for example, with a particular (or random) functionality affecting the spinning of the reel(s). A number sub-symbol may indicate that the reel should advance that particular number of positions, for example, while a directional arrow attribute/sub-symbol may alter (e.g., reverse) the direction in which the reel(s) spins. In some embodiments, the applicable reel effect for any given special attribute (which may itself be graphically represented by a particular graphical symbol or icon) may be determined by querying a database utilizing an identifier of the special attribute identified at 606. According to some embodiments, the reel effect(s) for any particular special attribute may be assigned and/or determined in a random and/or pseudo random manner (e.g., by utilizing an RNG to determine which pre-stored data record descriptive of reel effects is to be utilized or invoked).

In some embodiments, the method 600 may comprise causing (e.g., by the processing device), in accordance with each determined reel effect, a second reel of the slot-style game to rotate (and/or otherwise progress) in a particular manner, at 610. Reel effects may cause, for example, an identified and/or selected reel (i.e., slot matrix column) to progress a certain number of spaces and/or progress through spaces in a particular direction and/or pattern of directions. According to some embodiments, the reel affected by the reel effect may be randomly determined, may comprise a predetermined reel (e.g., based on game play rules and/or special attribute features), and/or may be selected by the player (e.g., the player may provide and the processing device may receive an indication of a selection, by the player, of one or more reels). In some embodiments, the special attributes and/or reel effects may be "banked", aggregated, collected, and/or otherwise stored and/or accumulated. According to some embodiments, a player may have control or influence over when and/or how such attributes are applied to affect the spinning of the reel(s). A player may transmit and the processing device may receive, for example, an indication of a selection of the player of one or more reels of the game along with a selection of one or more reel effects desired to be applied to the selected reel(s). In some embodiments, the aggregation of the special attributes and/or reel effects may be utilized to determine a secondary outcome and/or result for the game. Upon aggregation, accumulation, and/or achievement of a predetermined and/or threshold number, set, grouping, and/or combination of special attributes and/or reel effects, for example, certain benefits, rewards, and/or favorable game outcomes or results may be provided.

Figure 7A:
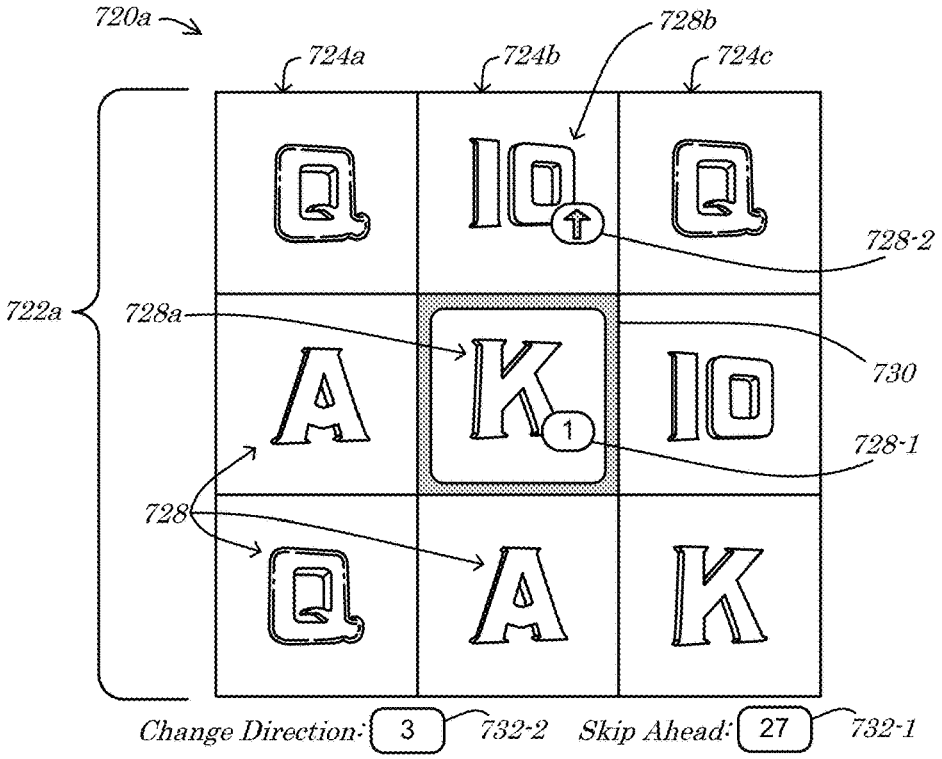
FIG. 7A, FIG. 7B, and FIG. 7C are diagrams of example slot-style interfaces according to some embodiments.
Figure 7B:
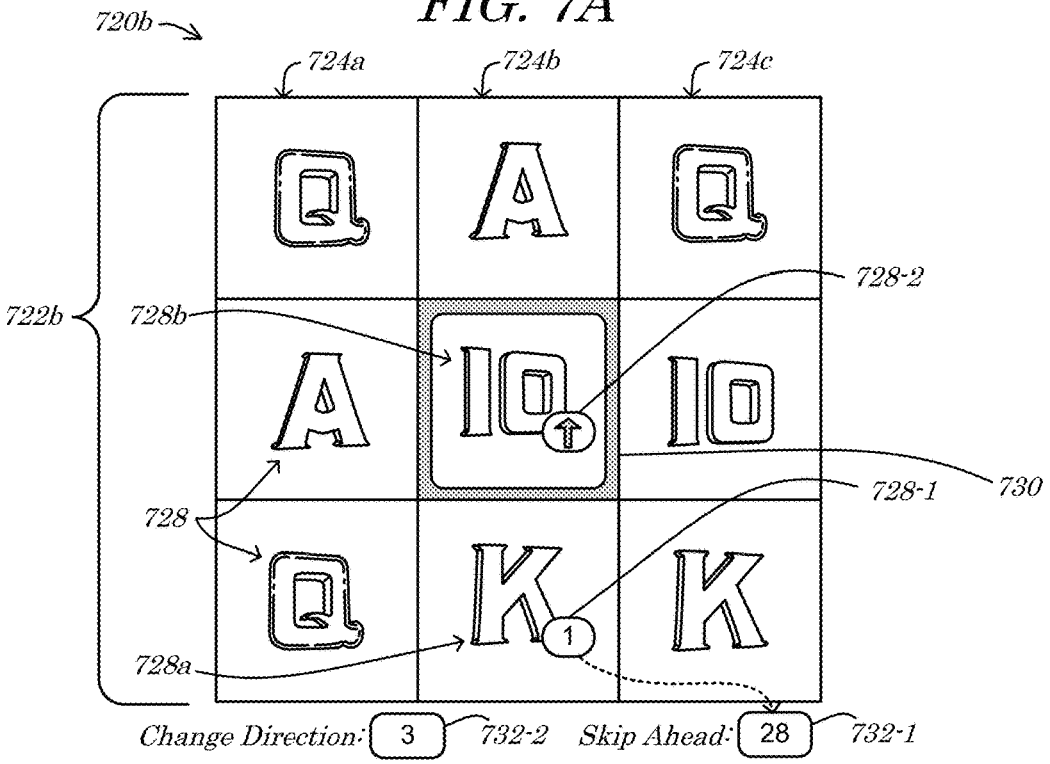
Figure 7C:
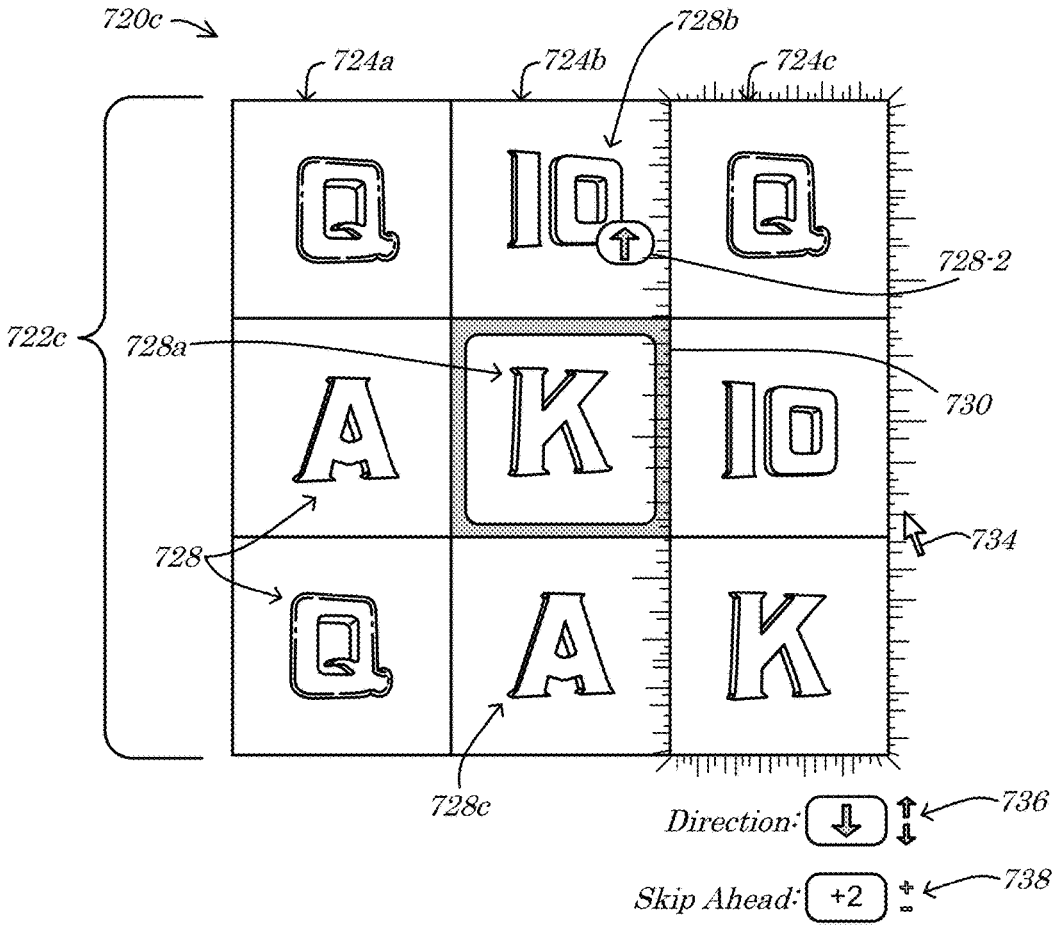

Turning now to FIG. 7A, FIG. 7B, and FIG. 7C, diagrams of example slot-style interfaces 720*a-c* according to some embodiments are shown. The example interfaces 720*a-c* may comprise, for example, one or more slot symbol matrices 722*a-c*, a plurality of slot "reels" (e.g., columns of the matrices 722*a-c*) 724*a-c*, and/or a plurality of slot symbols 728. As depicted, a first "reel" 724*a* may correspond to a first column of one or more of the slot symbol matrices 722*a-c*, a second "reel" 724*b* may correspond to a second column of one or more of the slot symbol matrices 722*a-c*, and/or a third "reel" 724*c* may correspond to a third column of one or more of the slot symbol matrices 722*a-c*. In some embodiments, one or more of the slot symbols 728 may not only comprise and/or be associated with or classified into a particular type of symbol (e.g., as depicted, four (4) different types of slot symbol 728 are populated in the slot symbol matrices 722*a-c;* "10", "Q", "K", "A") but may also comprise, be associated with, and/or be assigned a special attribute such as a first slot symbol 728*a* comprising a numeric special attribute 728-1 and/or a second slot symbol 728*b* comprising a logical special attribute 728-2. As depicted, in some embodiments the special attributes 728-1, 728-2 may be represented as sub-symbols and/or as portions or graphical attributes of the first and/or second slot symbols 728*a*, 728*b*, respectively.

According to some embodiments, the interfaces 720*a-c* and/or the slot symbol matrices 722*a-c* may comprise and/or identify a subset of reel positions 730. As depicted, for example, a single or central matrix position may be identified and/or selected as the subset of reel positions 730. In some embodiments, the subset of reel positions 730 may be tied to and/or may implement special game play functionality. Slot symbols 728 that pass into, through, and/or out of (or even pass by) the subset of reel positions 730 (or portions thereof, such as in the case the subset or reel positions 730 comprises multiple reel positions) may, for example, interact with the subset of reel positions 730 to produce various game play effects. According to some embodiments, any special attribute 728-1, 728-2 (or certain special attributes 728-1, 728-2) that are identified as having passed into, through, out of (or pass by) the subset of reel positions 730 may trigger certain game play actions—e.g., based on reel effects assigned to the special attributes 728-1, 728-2.

As an example, the numeric special attribute 728-1 of the first slot symbol 728*a* (a "K" symbol in the second column 724*b* of a first symbol matrix 722*a* in a first version of the interface 720*a*), upon passing into, through, or out of the subset of reel positions 730 may cause a counter to increment and/or may cause one or more reels 724*a-c* to progress (e.g., "rotate" or "spin") is a particular manner. As depicted, the first version of the interface 720*a* and/or a second version of the interface 720*b* may comprise one or more of a numeric attribute counter 732-1 (e.g., labeled "Skip Ahead") and a logical attribute counter 732-2 (e.g., labeled "Change Direction"). As shown for example purposes in FIG. 7A, the numeric attribute counter 732-1 represents a value of twenty-seven (27) and the logical attribute counter 732-2 represents a value of three (3). In some embodiments, the slot symbols 728 of the first matrix 722*a* may be reconfigured or progress to a different configuration depicted by a second symbol matrix 722*b* in FIG. 7B. For ease of illustration, for example, all slot symbols 728 depicted in the first symbol matrix 722*a* progress (or move) one position downward to arrive at their positions in the second slot matrix 722*b*. In some embodiments, slot symbols 728 that progress downward out of the matrices 722*a-c* are removed, while empty spaces created at the top of each reel 724*a-c* are occupied by new slot symbols 728.

As shown in FIG. 7B, the numeric special attribute 728-1 of the first slot symbol 728*a* (the "K" symbol in the second column 724*b*) causes an increment in the numeric attribute counter 732-1 from twenty-seven (27) to twenty-eight (28)—e.g., a value of one (1), which is the assigned value of the particular instance of the numeric special attribute 728-1. This may occur, for example due to the particular first slot symbol 728*a* progressing through or out of the subset of reel positions 730 as part of the progression from the first symbol matrix 722*a* to the second symbol matrix 722*b*. In some embodiments, the numeric special attribute 728-1 may also or alternatively cause one or more of the reels 724*a-c* to progress in a particular manner. Also as depicted in FIG. 7B, a second slot symbol 728*b* (a "10" symbol also in the second column 724*b*) comprising the logical special attribute 728-2 may pass into the subset of reel positions 730. In some embodiments, the logical special attribute 728-2 may, upon entering the subset of reel positions 730, cause one of the reels 724*a-c* to, for example, reverse progression direction. The logical special attribute 728-2 may, for example, cause the second reel 724*b* to progress upwards instead of downwards. Such a progression is depicted in the change from the second slot matrix 722*b* in FIG. 7B to a third slot matrix 722*c* in FIG. 7C.

As depicted, the second slot symbol 728*b* moves up one position as does the first slot symbol 728*a*, both on the second reel 724*b*. In some embodiments, such as depicted by the return of an third slot symbol 728*c* (an "A" symbol) to the bottom position of the second reel 724*b* in the third slot matrix 722*c*, in the case of a direction of progression reversal or change, previously discarded or removed slot symbols 728 may be returned to their previous position(s). According to some embodiments, new slot symbols 728 may instead fill empty positions of the matrices 722*a-c* due to progression. In some embodiments, the reversal of the second reel 724*b* may cause the first slot symbol 728*a* with the numeric special attribute 728-1 to re-enter the subset of reel positions 730. In some embodiments, such a re-entry may cause a second counter increment and/or a second reel progression alteration (e.g., multi-use or "perennial" special attributes 728-1, 728-2). In some embodiments, the re-entry may have no effect, as a special attribute 728-1, 728-2 may expire or become spent after any initial use (e.g., single-use special attributes 728-1, 728-2). As depicted in FIG. 7C, for example, upon re-entry into (or through, out of, or passing by) the subset of reel positions 730, the first slot symbol 728*a* in the second reel 724*b* may lose the numeric special attribute 728-1.

According to some embodiments, the various special attributes 728-1, 728-2 may be additive or cumulative and/or may otherwise operate simultaneously or consecutively upon the various reels 724*a-c*. In the case that both the numeric special attribute 728-1 having the value of one (1) and the logical special attribute 728-2 referencing the upward direction each pass through the subset of reel positions 730 (e.g., within a predetermined time window and/or in accordance with a certain sequence, such as consecutively), each respective reel effect may be applied to one or more of the reels 724*a-c*. As depicted in the progression from the second slot matrix 722*b* to the third slot matrix 722*c*, for example, the second reel 724*b* has progressed one (1) position upwards (e.g., based on the values and/or other characteristics of the reel effects attributable to the special attributes 728-1, 728-2 that have passed into, through, out of, and/or passed by the subset of reel positions 730). In the case that the numeric special attribute 728-1 had a value of two (2), for example, the second progression may instead have been two (2) positions upward.

According to some embodiments, such as depicted in FIG. 7C, a user of a third version of the interface 722*c* may utilize an input device such as a pointer 734 to select one or more of the slot reels 724*a-c* (the third reel 724*c* having been selected and/or identified in FIG. 7C, as indicated by the graphical highlighting). The user of the third version of the interface 722*c* (e.g., a player of the slot-style game represented by the third version of the interface 722*c*) may, for example, select the third reel 724*c* as the reel to which reel effects gathered by the subset of reel positions 730 (e.g., on the second reel 724*b*) should be applied. According to some embodiments, the third version of the interface 722*c* may comprise a progression direction tool 736 and/or a progression increment tool 738. The user may provide input utilizing the pointer 734 to interact with either or both of the progression direction tool 736 and the progression increment tool 738, for example, to specify (e.g., transmit, and a processing device may accordingly receive an indication of) desired progression parameters for the selected reel (e.g., the third reel 724*c*, as depicted). In some embodiments, the progression tools 736, 738 may be provided upon occurrence of one or more special attributes 728-1, 728-2 passing into, through, out of, and/or passing by the subset of reel positions 730. The user may, for example, be permitted to allocate associated reel effects to various reels 724*a-c* as desired. According to some embodiments, the progression tools 736, 738 may be utilized to allocate and/or utilize some or all banked or accumulated reel effects, such as those represented by the counters 732-1, 732-2 of FIG. 7A and/or FIG. 7B.

While certain slot symbols 728, 728*a*, 728*b*, 728*c*, certain size and/or configuration of slot symbol matrices 722*a-c*, certain numbers and/or locations of subset of reel positions 730, and/or certain special attributes 728-1, 728-2 (and/or associated reel effects) are depicted in FIG. 7A, FIG. 7B, and FIG. 7C for convenience and ease of illustration, other quantities, types, and/or configurations of such elements may be implemented without deviating from the scope of some embodiments. While reel progression is described simplistically as typically progressing in a downward fashion unless and/or until acted upon by an upward logical special attribute 728-2, for example, default progression may be otherwise configured and/or reel effects associated with logical special attributes 782-2 may comprise any logical parameter. Reel progression may, for example, be or be changed to downward, upward, left, right, and/or various diagonal directions, or combinations thereof (e.g., an up two (2) positions, left four (4) positions pattern or sequence).

Figure 8:
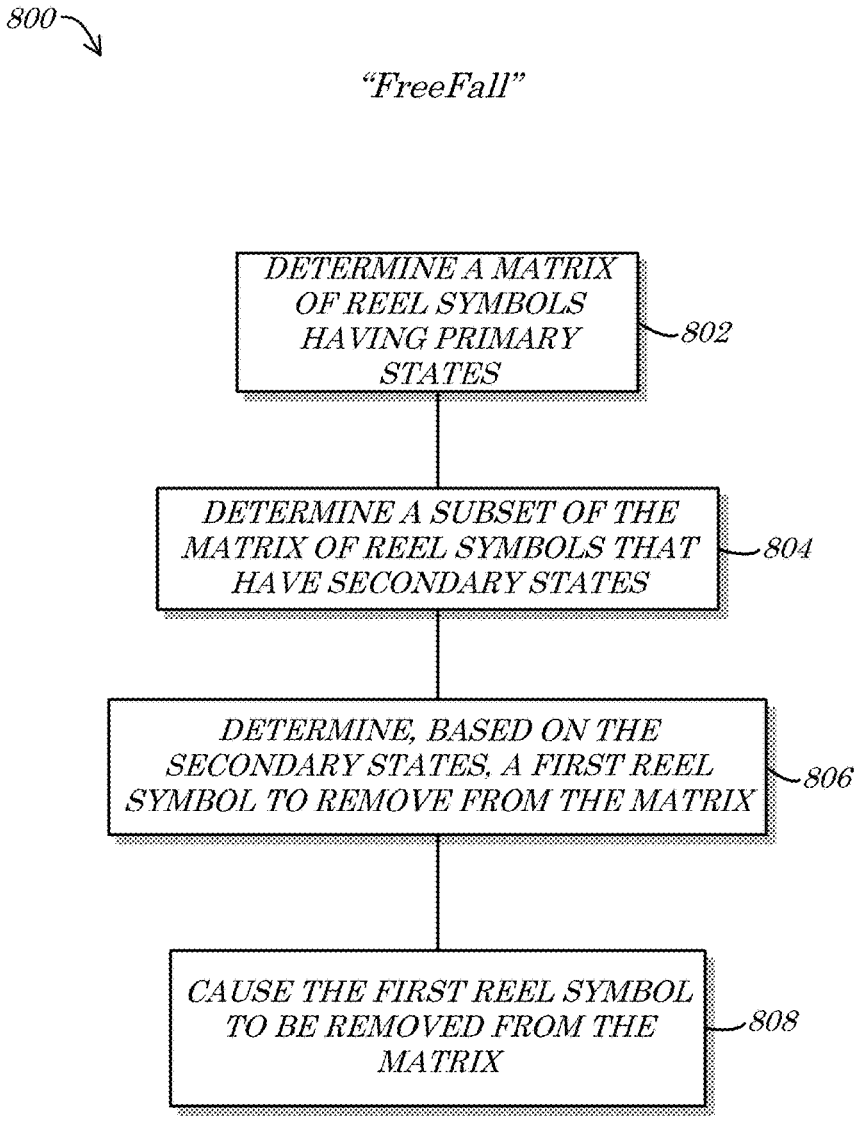
FIG. 8 is a flow diagram of a method according to some embodiments.

Referring now to FIG. 8, a flow diagram of a method 800 according to some embodiments is shown. In some embodiments, the method 800 may be descriptive of and/or result in an instance of a particular type or style of game such as a slot-style game titled "FreeFall", as depicted. According to some embodiments, the method 800 may be performed and/or implemented by and/or otherwise associated with one or more specialized and/or computerized processing devices (e.g., the player and/or user devices 102*a-n*, 202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein), specialized computers, computer terminals, computer servers, computer systems and/or networks, and/or any combinations thereof (e.g., by one or more online game providers and/or online gaming player processing devices). In some embodiments, the method 800 may be embodied in, facilitated by, and/or otherwise associated with various input mechanisms and/or interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein).

In some embodiments, the method 800 may comprise determining (e.g., by a processing device) a matrix of reel symbols for a slot-style game, each reel symbol comprising a primary state, at 802. In some embodiments, each primary state may be represented visually by different graphical elements of a symbol. The overall symbol type (e.g., "cherry") may represent the primary state utilized to determine outcomes in a primary game, for example.

According to some embodiments, the method 800 may comprise determining (e.g., by the processing device) a subset of the matrix of reel symbols that have secondary states, at 804. A sub-symbol (e.g., a "parachute" or "padlock") attached or superimposed to or on a primary symbol (e.g., to or on the "cherry") or a particular feature of the main symbol (e.g., dual stems as opposed to a single stem), for example, may represent the secondary state and/or may be utilized to determine outcomes in a secondary game. According to some embodiments, the secondary states may be hidden from players (e.g., even after determined). The secondary states (or a portion thereof) may be revealed to a player, for example, after a determination of a primary outcome (and/or result) based on the primary states.

In some embodiments, the method 800 may comprise determining (e.g., by the processing device), based on the secondary states, a first reel symbol of the subset to remove from the matrix, at 806. According to some embodiments, the secondary states may be utilized to determine which symbols to remove from the matrix and/or which symbols to maintain on the matrix, e.g., as part of game progression from a first matrix of symbols to a second matrix of symbols. In some embodiments, this removal/maintenance may occur prior to any primary outcome resolution—i.e., the removal/maintenance may affect primary game outcomes and/or results. In some embodiments, the secondary states may also or alternatively define how an associated symbol should be removed or moved with respect to the first matrix. While a parachute symbol and/or assigned secondary state progression mechanic may define that an associated symbol should be cascaded or tumbled off the matrix, for example, a different sub-symbol and/or assigned secondary state progression mechanic may define that the symbol should be removed from the matrix laterally (or moved within the matrix laterally).

According to some embodiments, the method 800 may comprise causing (e.g., by the processing device), based on the determination of the first reel symbol to remove from the matrix, a removal of the first reel symbol from the matrix, at 808. The first matrix may be altered, for example, based on one or more of the secondary states of the symbols from the original matrix to define a second matrix—i.e., a matrix progression in accordance with slot-style game play.

Figure 9A:
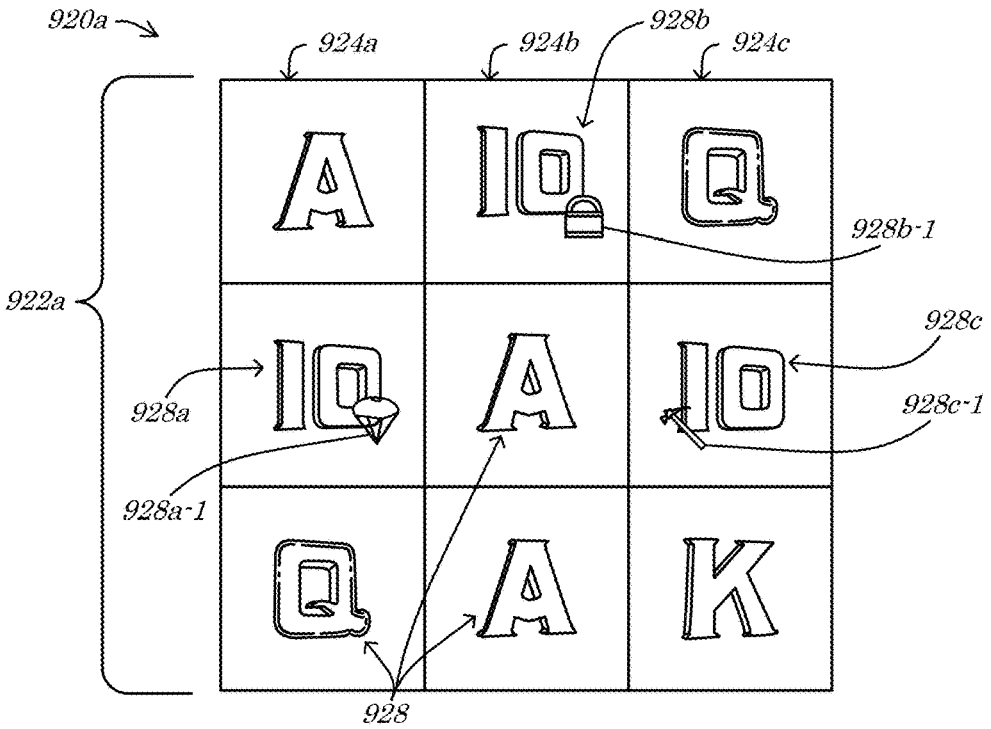
FIG. 9A and FIG. 9B are diagrams of example slot-style interfaces according to some embodiments.
Figure 9B:
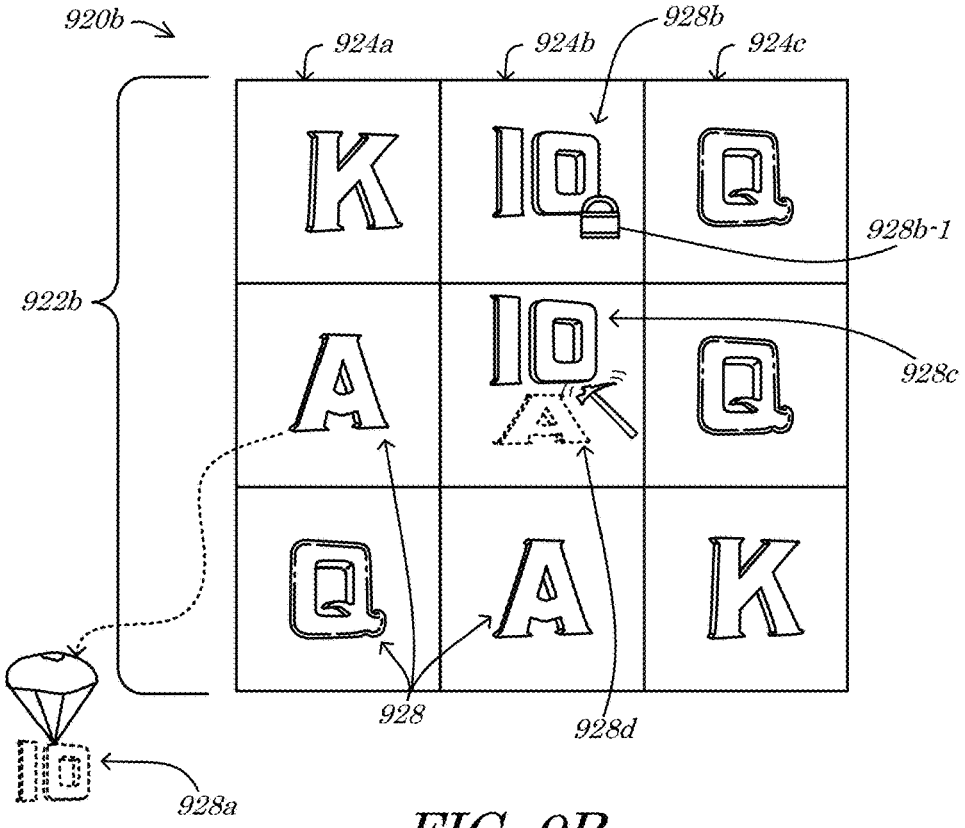

Turning now to FIG. 9A and FIG. 9B, diagrams of example slot-style interfaces 920*a-b* according to some embodiments are shown. The example interfaces 920*a-c* may comprise, for example, one or more slot symbol matrices 922*a-b*, a plurality of slot "reels" (e.g., columns of the matrices 922*a-b*) 924*a-c*, and/or a plurality of slot symbols 928. As depicted, a first "reel" 924*a* may correspond to a first column of one or more of the slot symbol matrices 922*a-b*, a second "reel" 924*b* may correspond to a second column of one or more of the slot symbol matrices 922*a-b*, and/or a third "reel" 924*c* may correspond to a third column of one or more of the slot symbol matrices 922*a-b*. In some embodiments, one or more of the slot symbols 928 (such as first, second, and/or third slot symbols 928*a*, 928*b*, 928*c*)

may not only comprise and/or be associated with or classified into a particular type of symbol and/or a particular primary state (e.g., as depicted, four (4) different types/states of slot symbol 928 are populated in the slot symbol matrices 922*a-b;* "10", "Q", "K", "A") but may also comprise, be associated with, and/or be assigned one or more secondary states 928*a*-1, 928*b*-1, 928*c*-1. As depicted, in some embodiments the one or more secondary states 928*a*-1, 928*b*-1, 928*c*-1 may be represented as sub-symbols and/or as portions or graphical attributes of the first, second, and/or third slot symbols 928*a*, 928*b*, 928*c*.

According to some embodiments, the one or more secondary states 928*a*-1, 928*b*-1, 928*c*-1 may define one or more features of slot-style game progression. In the case that a first slot matrix 922*a* of a first version of the interface 920*a* in FIG. 9A progresses to a second slot matrix 922*b* in the course of game play, for example, the one or more secondary states 928*a*-1, 928*b*-1, 928*c*-1 may define how the first, second, and/or third slot symbols 928*a*, 928*b*, 928*c* to which they are attached or assigned are to be progressed. As depicted, a first slot symbol 928*a* on the first reel 924*a* may comprise a primary slot state and/or symbol type depicted by the symbol "10" and may also comprise and/or be associated with a first secondary state 928*a*-1 (represented by the parachute icon in FIG. 9A). Upon progression of the first slot matrix 922*a* to the second slot matrix 922*b*, instead of the first slot symbol 928*a* simply progressing downward to the lowest position on the first reel 924*a* (e.g., a standard downward "spinning" progression), the first secondary state 928*a*-1 may cause or trigger the first slot symbol 928*a* to exit the first matrix 922*a* and/or the first reel 924*a* to the side, or simply disappear or be removed. As depicted, for example, the first slot symbol 928*a* "parachutes" away from the second slot matrix 922*b*, such as represented by an animated and/or video sequence during game play.

In some embodiments, a second slot symbol 928*b* may comprise a primary state and/or type (e.g., the symbol type "10" and/or associated functionality) as well as a second secondary state 928*b*-1, represented by the "lock" icon (e.g., in the first version of the interface 920*a* of FIG. 9A as well as in a second version of the interface 920*b* of FIG. 9B). According to some embodiments, the second secondary state 928*b*-1 may cause the second slot symbol 928*b* to remain in its original position in the first slot matrix 922*a* upon progression to the second slot matrix 922*b*—e.g., the second slot symbol 928*b* may be "locked" in-place. In some embodiments, the second secondary state 928*b*-1 (or any secondary state 928*a*-1, 928*b*-1, 928*c*-1) may remain active and/or attached or assigned to the second slot symbol 928*b* for a predetermined amount of time or a through a predetermined number of progressions (e.g., number of matrix positions progressed and/or number of "spins", plays, etc.).

According to some embodiments, a third slot symbol 928*c* may comprise a primary state and/or type (e.g., the symbol type "10" and/or associated functionality) as well as a third secondary state 928*c*-1, represented by the "hammer" or pick icon. In some embodiments, the third secondary state 928*c*-1 may cause the third slot symbol 928*c* to progress laterally (e.g., to the left as depicted) from the third reel 924*c* in the first slot matrix 922*a* to the second reel 924*b* in the second slot matrix 922*b*. The third slot symbol 928*c* may "hammer" a fourth slot symbol 928*d* (the "A" symbol in the middle position of the second slot matrix 922*b*) into non-existence, for example, and take its place. The third secondary state 928*c*-1 of the third slot symbol 928*c* may, effectively, define a symbol removal mechanic for one or more other symbols (e.g., the fourth slot symbol 928*d*) and/or may define a slot progression mechanic such as progressing the third slot symbol 928*c* laterally. In some embodiments, various secondary states 928*a*-1, 928*b*-1, 928*c*-1 may interact with other secondary states 928*a*-1, 928*b*-1, 928*c*-1 that occur in the same slot matrix 922*a-b* and/or that occur in specific patterns or orientations (e.g., in adjacent positions, or three different types of secondary state instances forming a sequence across a predetermined number and/or pattern of positions—e.g., in a row). 10*s*

While certain slot symbols 928, 928*a*, 928*b*, 928*c*, 928*d*, certain size and/or configuration of slot symbol matrices 922*a-b*, and/or certain secondary states 928*a*-1, 928*b*-1, 928*c*-1 (and/or associated reel effects) are depicted in FIG. 9A and FIG. 9B for convenience and ease of illustration, other quantities, types, and/or configurations of such elements may be implemented without deviating from the scope of some embodiments. While reel progression is described simplistically as typically progressing in a downward fashion unless and/or until acted upon by a particular secondary states 928*a*-1, 928*b*-1, 928*c*-1, for example, default progression may be otherwise configured and/or reel effects associated with secondary states 928*a*-1, 928*b*-1, 928*c*-1 may comprise any logical parameter. Reel progression and/or symbol progression may, for example, be or be changed to downward, upward, left, right, and/or various diagonal directions, or combinations thereof (e.g., an up two (2) positions, left four (4) positions pattern or sequence). While a single type of slot symbol 928, namely "10" symbols, are depicted as comprising secondary states 928*a*-1, 928*b*-1, 928*c*-1, and such may be the case in some embodiments, in other embodiments, different types of slot symbols 928 may also or alternatively comprise secondary states 928*a*-1, 928*b*-1, 928*c*-1, or different types of slot symbols 928 may comprise different types of secondary states 928*a*-1, 928*b*-1, 928*c*-1 (e.g., only certain occurrences of a certain slot symbol type may comprise a certain type of secondary state 928*a*-1, 928*b*-1, 928*c*-1).

Figure 10:
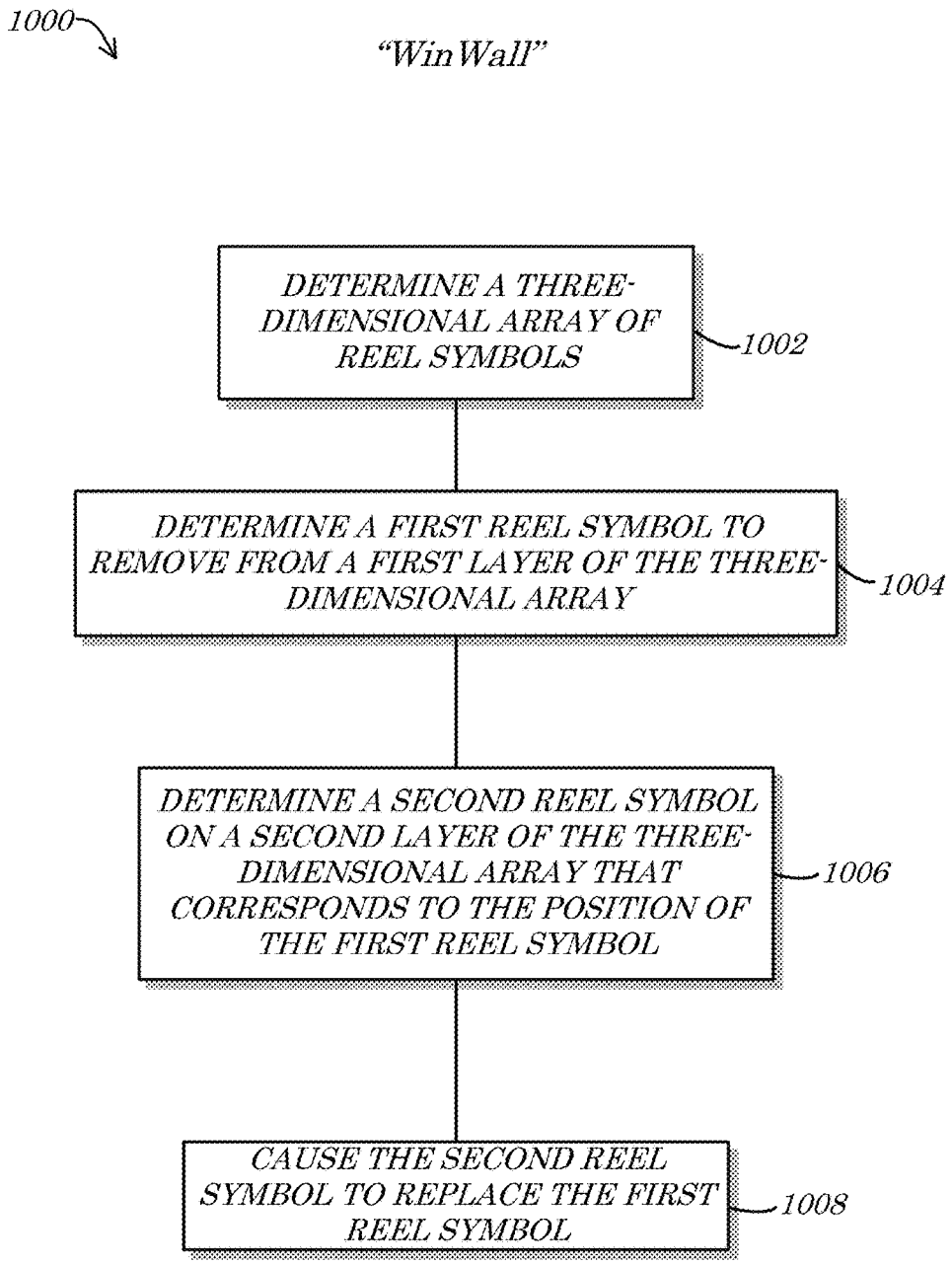
FIG. 10 is a flow diagram of a method according to some embodiments.

Referring now to FIG. 10, a flow diagram of a method 1000 according to some embodiments is shown. In some embodiments, the method 1000 may be descriptive of and/or result in an instance of a particular type or style of game such as a slot-style game titled "WinWall", as depicted. According to some embodiments, the method 1000 may be performed and/or implemented by and/or otherwise associated with one or more specialized and/or computerized processing devices (e.g., the player and/or user devices 102*a-n*, 202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein), specialized computers, computer terminals, computer servers, computer systems and/or networks, and/or any combinations thereof (e.g., by one or more online gaming company and/or online gaming player processing devices). In some embodiments, the method 1000 may be embodied in, facilitated by, and/or otherwise associated with various input mechanisms and/or interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein).

In some embodiments, the method 1000 may comprise determining (e.g., by a processing device) a three-dimensional array of reel symbols for a slot-style game, the array comprising, for each layer of depth in the array, a two-dimensional reel symbol matrix, each reel symbol in each matrix being identifiable by a particular two-dimensional position, at 1002. In some embodiments, a first two-dimensional matrix may be associated with a first depth in the three-dimensional array and a second two-dimensional matrix may be associated with a second depth in the three-dimensional array (and so on). The first and second depths may comprise, for example, adjacent depths. In some embodiments, the first depth may comprise a game result datum. Outcomes associated with the first matrix at the first depth/datum may, for example, be utilized to determine a result of a primary game (or a primary result of a game) and/or may be displayed in a dominant manner to players (e.g., overlaying—at least partially—other matrices at other depths).

In some embodiments, the first two-dimensional matrix may be populated with reel symbols based on a first Return-To-Player (RTP) probability and the second two-dimensional matrix may be populated with reel symbols based on a second RTP probability different than the first RTP probability. Different depths (e.g., layers) of reel symbol matrices may, for example, be associated with different payout probabilities and/or may be populated with symbols based on such differing probabilities. In some embodiments, the deeper the matrix, the higher the probability of a winning outcome, of a particular result, and/or of a payout.

According to some embodiments, the method 1000 may comprise determining (e.g., by the processing device), based on a reel symbol removal mechanic, a first reel symbol to remove from a first two-dimensional matrix of the three-dimensional array, at 1004. Various symbol removal mechanics/rules/processes may be utilized, for example, to determine one or more symbols to remove from the first matrix (e.g., standard removal mechanics and/or one or more of the novel removal mechanics described herein). In some embodiments, one or more of the methods 600, 800, 1200, 1400 of FIG. 6, FIG. 8, FIG. 12, and/or FIG. 14, and/or portions or combinations thereof, may be employed to determine which symbol(s) to remove.

In some embodiments, the method 1000 may comprise determining (e.g., by the processing device) a second reel symbol from a second two-dimensional matrix of the three-dimensional array, the second reel symbol having the same two-dimensional position as the first reel symbol, at 1006. In the case of two overlaid and/or associated matrices at different depths, for example, a symbol having the same row and column position as an overlaid symbol at a higher depth (e.g., deeper depth) may be selected to replace the overlaid symbol. In such a manner, for example, symbols underneath removed symbols may move up into the empty positions. In some embodiments, the removal and replacement may be replicated to deeper depths—e.g., a symbol in the same position at a third depth may move up to replace the symbol that was previously in the same position at the second depth.

According to some embodiments, the method 1000 may comprise causing (e.g., by the processing device) the second reel symbol to replace the first reel symbol, at 1008. The first reel symbol may be removed from the first two-dimensional matrix of the three-dimensional array, for example, and replaced with the second reel symbol from the second two-dimensional matrix of the three-dimensional array. In some embodiments, the first reel symbol, instead of being removed from the three-dimensional array, may be shifted to a new position in either the first two-dimensional matrix of the three-dimensional array or a different matrix of the three-dimensional array. According to some embodiments, the first reel symbol may "swap" positions with the second reel symbol, and thus take the second reel symbol's previous position in the second two-dimensional matrix.

Figure 11:
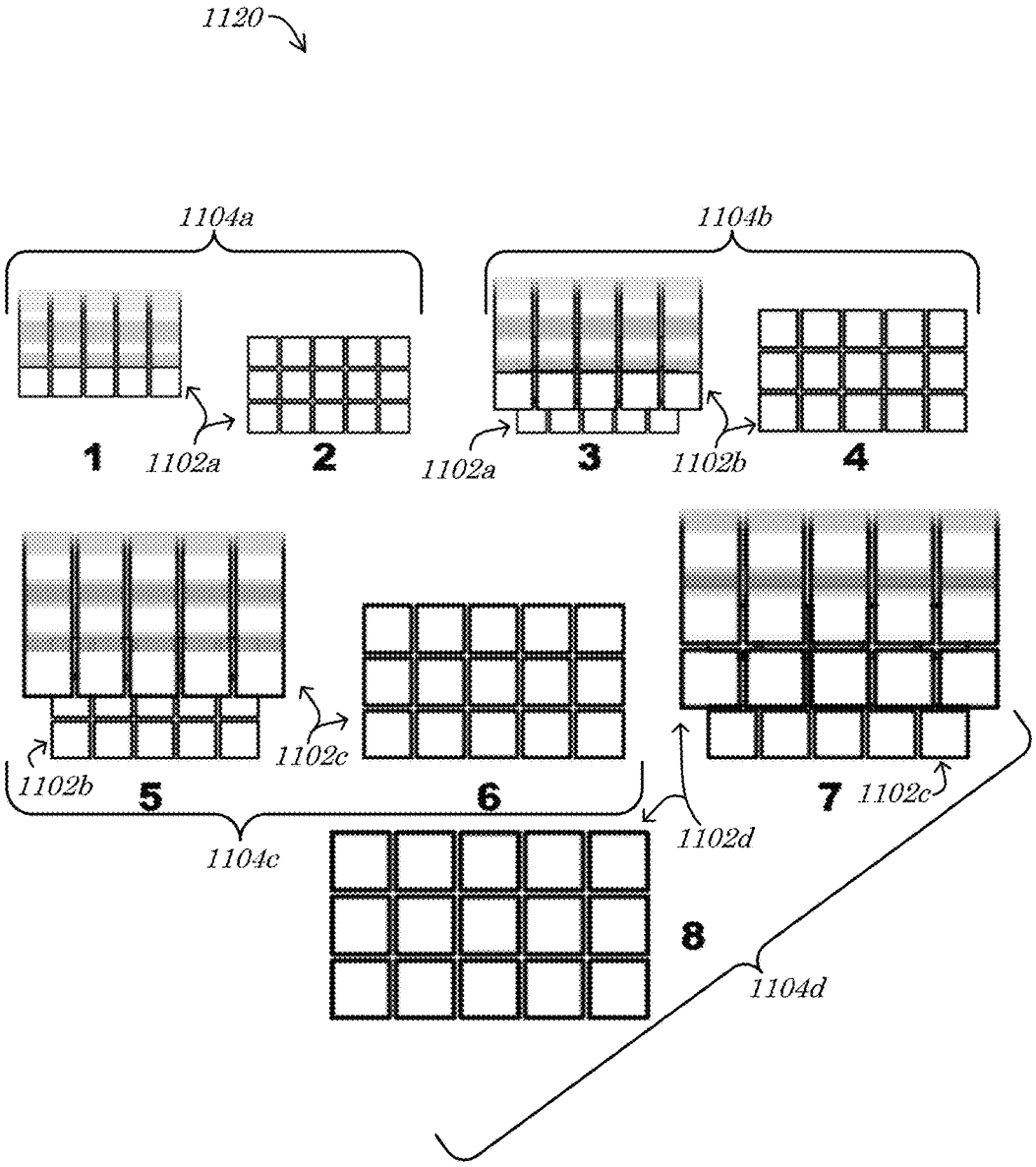
FIG. 11 is a diagram of an example slot-style interface according to some embodiments.

Referring now to FIG. 11, a diagram of an example interface 1120 according to some embodiments is shown. In some embodiments, the example interface 1120 may be facilitated, implemented, and/or effectuated by one or more of the systems 100, 200, 300, 400, 500 of FIG. 1, FIG. 2, FIG. 3, FIG. 4, and/or FIG. 5, and/or one or more components, portions, and/or combinations thereof. In some embodiments, the example interface 1120 may comprise a plurality of symbol matrices 1102*a-d* overlaid upon one another.

According to some embodiments (as depicted), the matrices 1102*a-d* may be populated and/or represented in a particular fashion—e.g., a "spin" comprising any sort of physical and/or virtual animation of the "reels" (e.g., columns) comprising the matrices 1102*a-d*. A first "spin" event 1104*a* may comprise a spinning (at "1") of a first matrix 1102*a*, for example, that results in a population of the first matrix 1102*a* (at "2"). A second "spin" event 1104*b* may then, for example, comprise a spinning (at "3") of a second matrix 1102*b* and/or a population of the second matrix 1102*b* (at "4"). As depicted, in some embodiments, the second matrix 1102*b* may be overlaid at least partially on top of (e.g., graphically) the first matrix 1102*a* (e.g., at "3" or "4"). In some embodiments, the overlay may be partial (e.g., at "3"), such as during spinning/populating of the second matrix 1102*b* (at "3"). In some embodiments, such as in the case that the spinning has completed, the second matrix 1102*b* may be superimposed on and/or replace (e.g., graphically) the first matrix 1102*a* (at "4"). According to some embodiments, this spinning, populating, and overlying/replacing may continue (e.g., for a third spin 1104*c* (at "5") and/or population (at "6") of a third matrix 1102*c* and/or for a fourth spin 1104*d* (at "7") and/or population (at "8") of a fourth matrix 1102*d*) until a final or game datum matrix (in the case of the example of FIG. 11, the fourth matrix 1102*d*) is populated. In some embodiments, even though the underlaid matrices 1102*a-c* may not be visible (or entirely visible), their symbols and/or outcomes may be known and/or stored by the gaming system. In such a manner, for example, should one of the symbols of the fourth matrix 1102*d* be removed (e.g., in accordance with a symbol removal mechanism, some of which are described herein), one of the corresponding symbols from one of the underlying matrices 1102*a-c* may be moved up to fill the vacated position.

While the connections between the matrices 1102*a-d* are generally described as being rectilinearly paired (e.g., position 1:2 in the first matrix 1102*a* is connected to position 1:2 in the second matrix 1102*b*), other connection arrangements may be implemented without deviating from the scope of some embodiments. Positional connections may be more complex in accordance with various patterns or mathematical formulas, for example, may be randomly defined, and/or may be at least partially defined (even wholly defined) by a player of the game. According to some embodiments, the connections may also or alternatively join reel positions between matrices 1102*a-d* that are not arranged and/or situated adjacently in the three-dimensional array. One or more positions of the first matrix 1102*a* may join or connect to one or more positions of the third matrix 1102*c* and/or the fourth matrix 1102*d*, for example.

Figure 12:
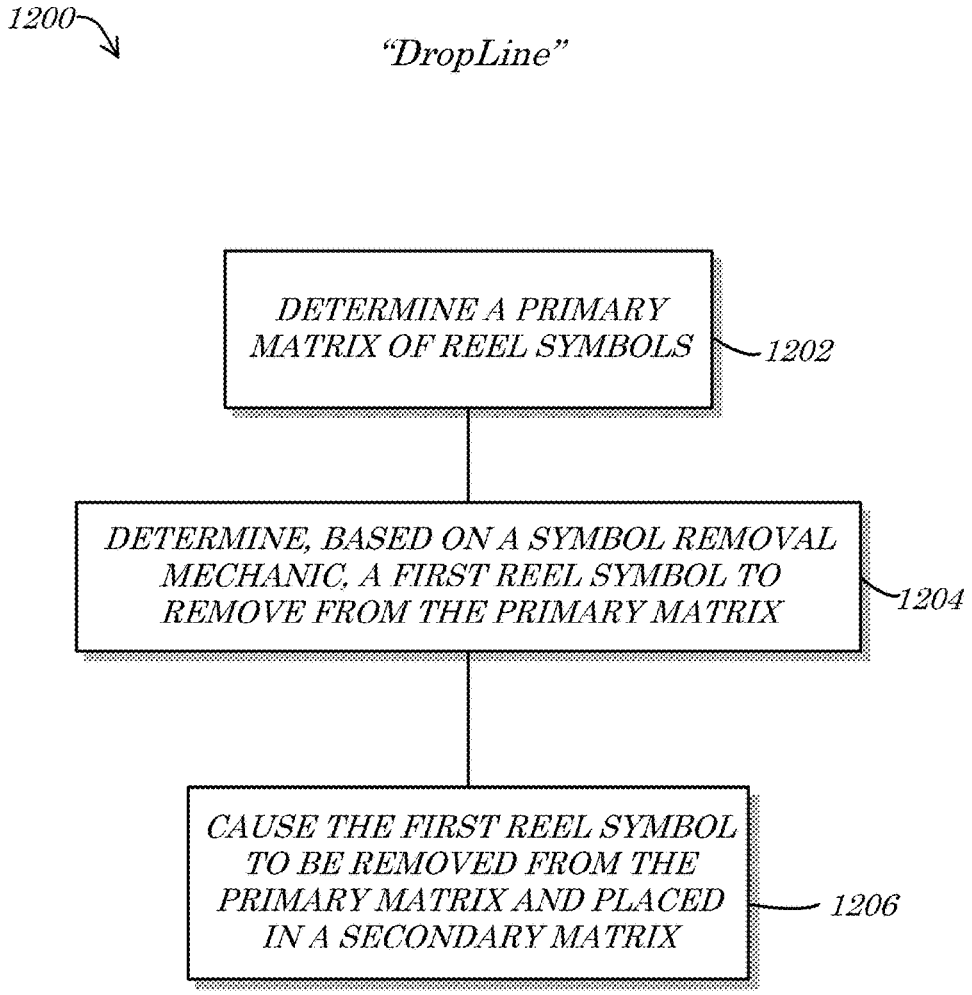
FIG. 12 is a flow diagram of a method according to some embodiments.

Referring now to FIG. 12, a flow diagram of a method 1200 according to some embodiments is shown. In some embodiments, the method 1200 may be descriptive of and/or result in an instance of a particular type or style of game such as a slot-style game titled "DropLine", as depicted. According to some embodiments, the method 1200 may be performed and/or implemented by and/or otherwise associated with one or more specialized and/or computerized processing devices (e.g., the player and/or user devices 102*a-n*,

202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein), specialized computers, computer terminals, computer servers, computer systems and/or networks, and/or any combinations thereof (e.g., by one or more online gaming company and/or online gaming player processing devices). In some embodiments, the method 1200 may be embodied in, facilitated by, and/or otherwise associated with various input mechanisms and/or interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein).

In some embodiments, the method 1200 may comprise determining (e.g., by a processing device) a primary matrix of reel symbols for a slot-style game, at 1202. A primary matrix defining various reel positions may be populated with randomly-selected and/or derived symbols or values, for example, in accordance with one or more of various potential matrix population mechanics and/or algorithms.

According to some embodiments, the method 1200 may comprise determining (e.g., by the processing device), based on a reel symbol removal mechanic, a first reel symbol to remove from the primary matrix, at 1204. In some embodiments, any of the method 600, 800, 1000, 1400 of FIG. 6, FIG. 8, FIG. 10, and/or FIG. 14, and/or portions or combinations thereof, may be employed to determine which symbol(s) to remove. In some embodiments, the removal mechanic may comprise a rule that the first reel symbol comprises a random reel symbol from one of the columns of the primary matrix. According to some embodiments, the removal mechanic may comprise a rule that the first reel symbol comprises a random reel symbol from one of the rows of the primary matrix.

In some embodiments, the method 1200 may comprise causing (e.g., by the processing device) the first reel symbol to be removed from the primary matrix and placed in a secondary matrix, at 1206. According to some embodiments, the method 1200 may comprise determining (e.g., by the processing device), after the causing of the removal and based on the primary matrix, a primary outcome of the game. In some embodiments, the method 1200 may comprise determining (e.g., by the processing device), after the determining of the primary outcome, and based on the secondary matrix, a secondary outcome of the game. In some embodiments, the primary outcome may comprise an outcome of a primary game and the secondary outcome may comprise an outcome of a secondary game.

Figure 13:
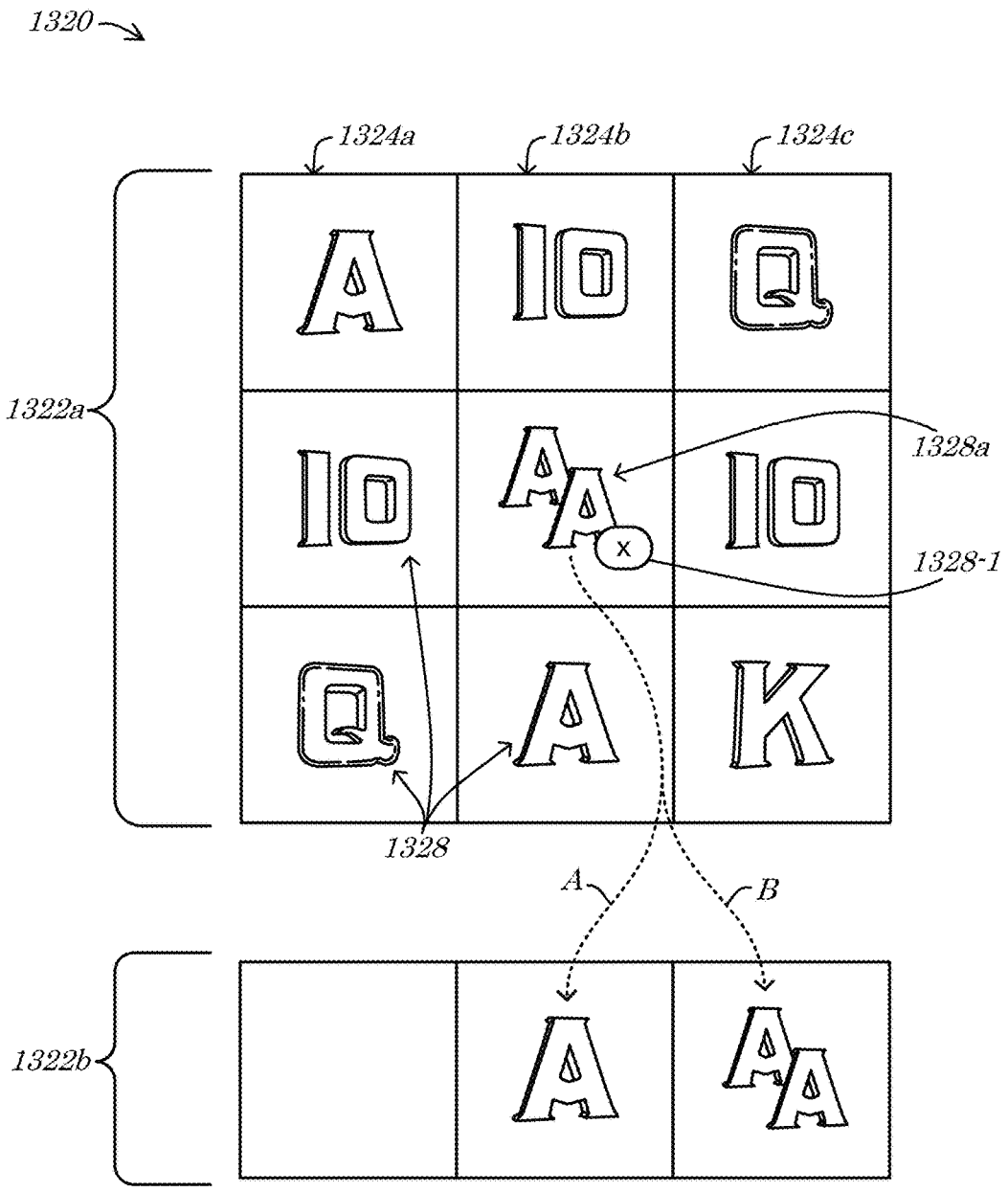
FIG. 13 is a diagram of an example slot-style interface according to some embodiments.

Turning now to FIG. 13, a diagram of an example slot-style interface 1320 according to some embodiments is shown. The example interface 1320 may comprise, for example, one or more slot symbol matrices 1322*a-b*, a plurality of slot "reels" (e.g., columns of the matrices 1322*a-b*) 1324*a-c*, and/or a plurality of slot symbols 1328. In some embodiments, one or more of the reel symbols 1328 may be removed from a primary or first slot matrix 1322*a* as a slot-style game progression mechanic. One or more removal mechanic rules may, for example, govern how and/or when certain reel symbols 1328 and/or reel symbols 1328 in certain positions in the first matrix 1322*a* are to be removed. According to some embodiments, it may be determined that a first slot symbol 1328*a* should be removed from the first matrix 1322*a*. In some embodiments, the removal may be based on the type of the first reel symbol 1328*a* (e.g., as depicted, a double "A"), the position of the first reel symbol 1328*a* (e.g., in the central position of the first matrix 1322*a* and/or in the middle or second position of the second reel 1324*b*), a relationship between the first reel symbol 1328*a* and/or its position with respect to other reel symbols 1328 (such as those that are adjacent and/or of a certain type), and/or based on a sub-symbol 1328-1 that represents a secondary state and/or special symbol or reel attribute, as described herein.

According to some embodiments, the first reel symbol 1328*a* may be removed from the first matrix 1322*a* and placed in or moved to a secondary or second matrix 1322*b*. The first reel symbol 1328*a* may be randomly allocated to one (or more) of the positions of the second matrix 1322*b*, for example, or may be assigned to a particular position in the second matrix 1322*b*. As depicted in FIG. 13, the first reel symbol 1328*a* may itself be propagated and/or moved into the second matrix 1322*b*, as depicted by dotted path "A", for example, or may cause a population of a different type of symbol 1328 into the second matrix 1322*b*, as depicted by the dotted path "B". In some embodiments, the first symbol 1328*a* may not be removed from the first matrix 1322*a*, but may instead alter form or type as a result of and/or in connection with the associated population of the second matrix 1322*b*. The double "A" of the first reel symbol 1328*a* may, for example, lose one of the "A"s to the second matrix 1322*b* (e.g., via path "A") while one of the "A"s remains—effectively transforming the first reel symbol 1328*a* in the first matrix 1322*a* from a double "A" type to a single "A" type.

In some embodiments, the first matrix 1322*a* may be utilized to resolve and/or determine an outcome of a primary or first game such as a slot-style game, while the second matrix 1322*b* may be utilized to resolve and/or determine an outcome of a secondary or second game, such as a bonus game or a stand-alone secondary game. In the case that the removal occurs prior to a primary game outcome determination, the removal may affect such outcome of the primary game.

While certain slot symbols 1328, 1328*a*, certain size and/or configuration of slot symbol matrices 1322*a-b*, and/or certain special attributes 1328-1 (and/or associated reel effects) are depicted in FIG. 13 for convenience and ease of illustration, other quantities, types, and/or configurations of such elements may be implemented without deviating from the scope of some embodiments.

Figure 14:
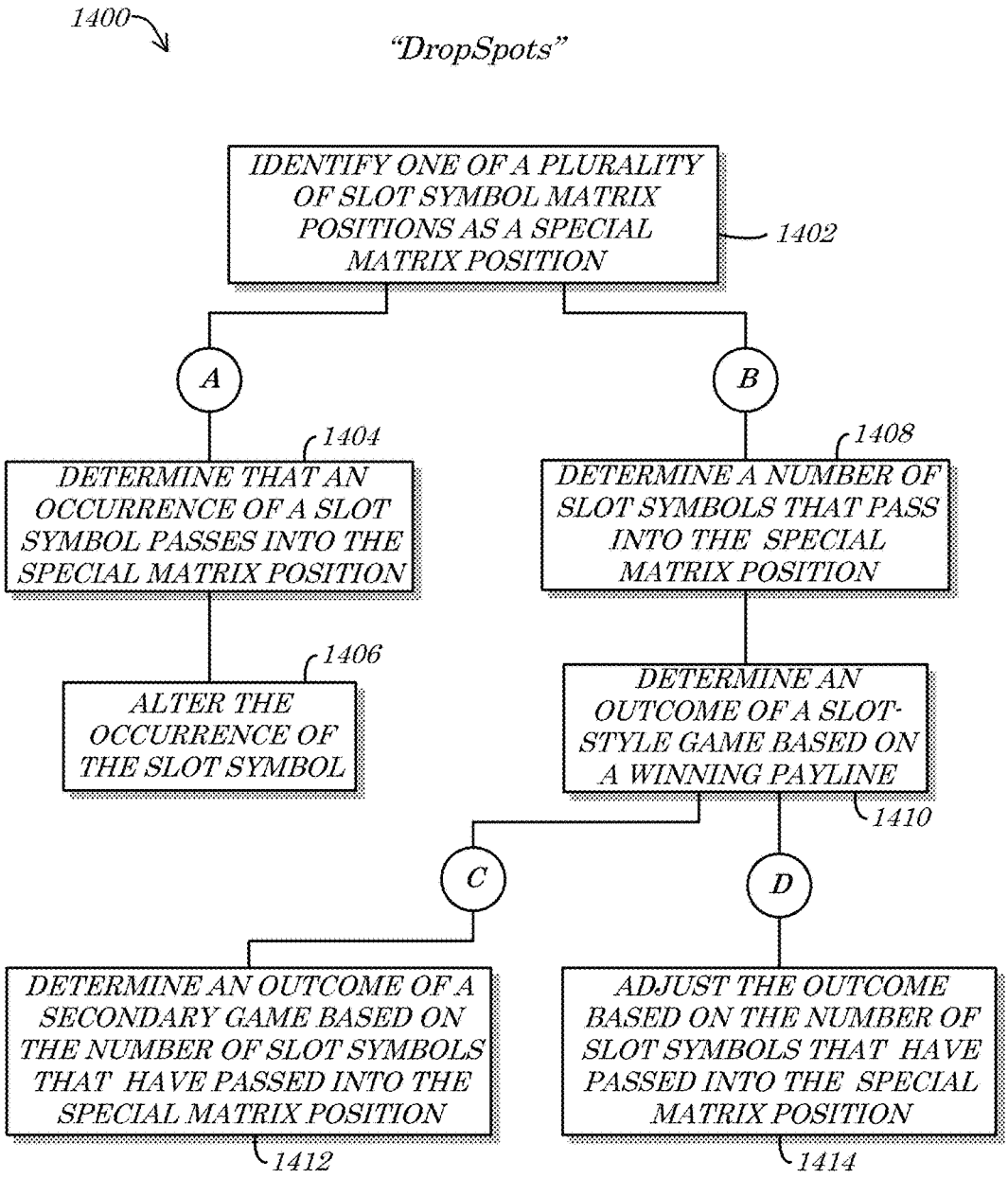
FIG. 14 is a flow diagram of a method according to some embodiments.

Referring now to FIG. 14, a flow diagram of a method 1400 according to some embodiments is shown. In some embodiments, the method 1400 may be descriptive of and/or result in an instance of a particular type or style of game such as a slot-style game titled "DropSpots", as depicted. According to some embodiments, the method 1400 may be performed and/or implemented by and/or otherwise associated with one or more specialized and/or computerized processing devices (e.g., the player and/or user devices 102*a-n*, 202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein), specialized computers, computer terminals, computer servers, computer systems and/or networks, and/or any combinations thereof (e.g., by one or more online gaming company and/or online gaming player processing devices). In some embodiments, the method 1400 may be embodied in, facilitated by, and/or otherwise associated with various input mechanisms and/or interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein).

In some embodiments, the method 1400 may comprise identifying (e.g., by a processing device) one of a plurality of slot symbol matrix positions as a special matrix position, at 1402. A predetermined position, randomly-determined position, and/or player-selected position may, for example, be identified as being different from the other slot symbol matrix positions. In some embodiments, this difference may cause changes in game play and/or game outcomes or results. In the example case of a three-by-three (3×3) matrix, for example, the center matrix position (i.e., column two, row two, or "2:2") may be automatically selected and/or identified as the special matrix position. In some embodiments, more than one special position may be chosen, selected, identified, and/or otherwise determined. In some embodiments, different locations of a special matrix position may occur at different times, times of day, days of the week, seasonally, based on player identifying information (e.g., identity, player value, location, demographics), and/or based on player performance and/or game play parameters.

According to some embodiments, the method 1400 may proceed in accordance with one or more alternate progressions, such as either a first progression "A" or a second progression "B" as depicted. While in some embodiments such progressions may be mutually exclusive, in other embodiments such progressions are not mutually exclusive (e.g., both the first progression "A" and the second progression "B" may be effectuated in concert, together, sequentially, consecutively, and/or in accordance with one or more related processes). The method 1400 may, for example, proceed in accordance with the first progression "A" to effectuate a determining (e.g., by the processing device) that an occurrence of a slot symbol has passed into the special matrix position(s), at 1404. Upon a reel spin, simulated spin, virtual spin, and/or cascade or other slot symbol matrix population mechanic, for example, it may be determined that the special matrix position(s) is populated and/or that one or more symbols 'pass through' the special matrix position(s)—e.g., such as in the case of a cascading slot symbol matrix population mechanic where symbols destined to the bottom row, for example, fall or pass through matrix positions of higher-positioned rows prior to arriving at their ultimate destination for a particular slot symbol matrix population event. In some embodiments, any symbol instances or occurrences passing into, out of, and/or through the special matrix position(s) may be flagged, tagged, tabulated, and/or otherwise noted or recorded.

In some embodiments, the method 1400 may comprise (e.g., in accordance with a furtherance of the first progression "A") altering (e.g., by the processing device) the occurrence of the slot symbol, at 1406. The slot symbol(s) determined to have passed into, out of, and/or through the special matrix position(s) at 1404, for example, may be altered based on the occurrence of the special position pass through/into/out of event. A first slot symbol occurrence of a first symbol type "CHERRY", for example, may be transformed (e.g., after having passed into, through, and/or out of the special matrix position(s)) into a second symbol type "ORANGE". In some embodiments, merely the icon and/or graphical representation of the symbol occurrence may be transformed, while the underlying odds, value, state (primary and/or secondary), and/or effect (e.g., on payline outcome determinations) of the occurrence of the symbol may remain the same as it originally was. According to some embodiments, the occurrence of the symbol may be fully transformed into and/or replaced by a different symbol type (e.g., of a different value and/or effect). In some embodiments, the altering of the symbol occurrence may comprise an altering of the 'population path' of the symbol occurrence. In the case of a cascading symbol population mechanic, for example, the symbol occurrence may be initially destined for a matrix position underneath the position of the special matrix position and upon passing into, through, and/or out of the special matrix position, the trajectory and accordingly the ultimate destination of the occurrence of the symbol may change. The symbol may be 'deflected' diagonally to a different column, for example, or may even reverse direction and be utilized to populate a matrix position occurring previous to the special matrix position in accordance with any particular symbol population mechanic utilized. According to some embodiments, the altering may comprise a setting, changing, and/or addition of a slot sub-symbol, value, state, special attribute, and/or parameter. In some embodiments, the sub-symbol, value, state, special attribute, and/or parameter may be utilized to alter, define, and/or effect primary game (e.g., slot-style game) outcomes and/or secondary game outcomes.

According to some embodiments, the method 1400 may also or alternatively proceed in accordance with the second progression "B" to effectuate a determining (e.g., by the processing device) of a number of slot symbols that pass into the special matrix position(s), at 1408. The number of slot symbols (total, broken-down and/or tabulated by type) may be recorded, for example, for a specific period and/or window of time and/or for a particular number of spins, game plays, and/or based on other game play parameters (e.g., coin-in, credit balance, loss and/or win amounts). According to some embodiments, symbols and/or symbol types may be scored and/or ranked based on how many pass into the special matrix position(s) to populate the position, how many pass through the special matrix position (in accordance with a population mechanic that places those symbols in different positions other than the special position(s)), and/or how many pass out of the special position(s) (such as in the case that symbols can be generated within and/or emanate from the special position(s).

In some embodiments, the method 1400 may comprise determining (e.g., by the processing device) an outcome of a slot-style game based on a winning payline, at 1410. The matrix of symbol positions populated with slot symbols may, for example, be evaluated to determine if any winning combinations of symbols exist along one or more paylines through the matrix. According to some embodiments, the evaluation of a winning payline may cause and/or be succeeded by one or more of a plurality of possible progressions, such as the third progression "C" and/or the fourth progression "D" depicted in FIG. 14. While in some embodiments such progressions may be mutually exclusive, in other embodiments such progressions are not mutually exclusive (e.g., both the third progression "C" and the fourth progression "D" may be effectuated in concert, together, sequentially, consecutively, and/or in accordance with one or more related processes). In some embodiments, the method 1400 may proceed in accordance with the third progression "C" to effectuate a determining (e.g., by the processing device) of an outcome of a secondary game based on the number of slot symbols that have passed into the special matrix position(s), at 1412. The outcome of the slot-style game, such as a primary game for example, may be provided to a player and the outcome of the secondary game (e.g., a bonus game or entirely separate game) may also or alternatively be provided to the player—the outcome of the secondary game being based on the 'pass-through' symbol count, score, ranking, etc. In some embodiments, the outcomes of the primary and secondary games may be combined and provided to the player.

According to some embodiments, the method 1400 may proceed in accordance with the fourth progression "D" to effectuate an adjusting (e.g., by the processing device) of the outcome of the slot-style game based on the number of slot symbols that have passed into the special matrix position(s), at 1414. In the case that no secondary game is involved with or effected by the special matrix position(s), for example, the 'pass-through' activity of the special matrix position(s) may be utilized to adjust and/or otherwise effect the outcome of the primary game. The outcome may be enhanced, multiplied, magnified, reduced, delayed, and/or otherwise adjusted. In some embodiments, the number of 'pass-through' symbols (and/or number of 'pas-through' symbols of one or more particular types and/or having one or more particular attributes). According to some embodiments, the number of 'pass-through' symbols may affect the outcome of the primary game (pursuant to the fourth progression "D") as well as affect and/or define a secondary game outcome (pursuant to the third progression "C"). The 'pass-through' activity of one or more special matrix positions, for example, may mathematically affect or define the primary game outcome (such as a multiplier applied to the base primary game outcome) in one manner, while also mathematically affecting or defining the secondary game outcome (such as a bonus achievement based on the number of a certain type of symbol that have passed into the special matrix position(s)).

Turning now to FIG. 15A, FIG. 15B, FIG. 15C, and FIG. 15D, diagrams of example slot-style interfaces 1520*a-d* according to some embodiments are shown. The example interfaces 1520*a-d* may comprise, for example, one or more slot symbol matrices 1522*a-d*, a plurality of slot "reels" (e.g., columns of the matrices 1522*a-d*) 1524*a-c*, one or more paylines 1526*a-b*, and/or a plurality of slot symbols 1528, 1528*a*, 1528*b*, 1528*c*, 1528*d*. As depicted, a first "reel" 1524*a* may correspond to a first column of one or more of the slot symbol matrices 1522*a-d*, a second "reel" 1524*b* may correspond to a second column of one or more of the slot symbol matrices 1522*a-d*, and/or a third "reel" 1524*c* may correspond to a third column of one or more of the slot symbol matrices 1522*a-d*. In some embodiments, one or more of the slot symbols 1528 may not only comprise and/or be associated with or classified into a particular type of symbol (e.g., as depicted, four (4) different types of slot symbol 1528 are populated in the slot symbol matrices 1522*a-d;* "10", "Q", "K", "A") but may also comprise, be associated with, and/or be assigned a special attribute such as a first slot symbol 1528*a* comprising a numeric special attribute 1528*a*-1. As depicted, in some embodiments the numeric special attribute 1528*a*-1 may be represented as a sub-symbol and/or as a portion or graphical attribute of the first slot symbol 1528*a*.

According to some embodiments, the interfaces 1520*a-d* and/or the slot symbol matrices 1522*a-d* may comprise and/or identify a subset of reel positions 1530*a-c* which may, for example, be referred to as one or more "special" matrix positions. As depicted in FIG. 15A and FIG. 15B, for example, a single or central matrix position may be identified and/or selected as a first (or only) special reel position 1530*a*. In some embodiments, any or all special reel positions 1530*a-c* may be tied to and/or may implement special game play functionality. Slot symbols 1528 that pass into, through, and/or out of (or even pass by) any or all of the special reel positions 1530*a-c* (or portions thereof, such as in the case the any or all special reel positions 1530*a-c* comprise multiple reel positions; e.g., as depicted in FIG. 15C and FIG. 15D) may, for example, interact with the any or all special reel positions 1530*a-c* to produce various game play effects.

In some embodiments, a first version of the interface 1520*a* (in FIG. 15A) comprising a first slot matrix 1522*a* may represent a first stage and/or time during the slot-style game while a second version of the interface 1520*b* (in FIG. 15B) comprising a second slot matrix 1522*b* may represent a second stage and/or time during the slot-style game. The first and second versions of the interface 1520*a-b* may, for example, depict a game play progression from the first slot matrix 1522*a* to the second slot matrix 1522*b*. For ease of illustration, the depicted progression shows the slot symbols 1528 moving one position downward from initial (or first) positions in the first slot matrix 1522*a* to second positions in the second slot matrix 1522*b*. In some embodiments, a first payline 1526*a* may be evaluated with respect to the first slot matrix 1522*a*. Resolution of the first payline 1526*a* may, for example, comprise a first outcome of the game (e.g., a primary game) and may cause and/or lead to a first result and/or payout (not shown). In some embodiments, the first payout/result or outcome may be modified based on a number associated with the first special matrix position 1530*a*. Slot symbols 1528 passing into, through, out of, and/or by the first special matrix position 1530*a*, for example, may increment and/or otherwise affect a counter 1532. As depicted in FIG. 15A with respect to the first slot matrix 1522*a*, the counter 1532 has a value of zero (0). In some embodiments, the value of the counter 1532 may be mathematically (or logically) interacted with the first outcome or result. The zero (0) may, for example, be added to a value of the first outcome or result, defining a first modified outcome or result.

According to some embodiments, once the first slot symbol 1528*a* passes into (and/or through, out of, or passes by) the first special matrix position 1530*a*, such as depicted in FIG. 15B with respect to the second slot matrix 1522*b*, the counter 1532 may be incremented or altered such as by changing from the value of zero (0) to a value of one (1) (not shown), to represent the occurrence of a single slot symbol 1528 (e.g., any slot symbol 1528 or a slot symbol 1528 of a certain type, such as the first slot symbol 1528*a* being a "10" symbol) passing into the first special matrix position 1530*a*. In some embodiments, the value of the counter 1532 may be set and/or incremented of altered based on a secondary state and/or special attribute such as the first special attribute 1528*a*-1 of the first slot symbol 1528*a* passing into the first special matrix position 1530*a*. The value of the first special attribute 1528*a*-1 being fifty (50) for purposes of example, may cause the value of the counter 1532 to increase from zero (0) to fifty (50).

In some embodiments, the updated, incremented, and/or adjusted value of the counter 1532 may be utilized to affect either or both of an outcome or result of the primary slot-style game or an outcome or result of a secondary game (not explicitly shown). At the second time and/or state of the primary slot-style game depicted in the second version of the interface 1520*b* and comprising the second slot matrix 1522*b*, for example, a second payline 1526*b* may be resolved. According to some embodiments, the second payline 1526*b* may be resolved in a standard fashion, such as by taking into account the three "10" slot symbols 1528 (including the first slot symbol 1528*a*) disposed along the horizontally-oriented second payline 1526*b* and resolving (e.g., determining a result for the primary game) the achieved pattern (e.g., the achieved outcome) with a pay table (not shown). According to some embodiments, the outcome and/or the result of the primary game may be modified by mathematically and/or logically applying the value of the counter 1532. The value of the counter 1532, after having been set or adjusted based on the first special attribute 1528*a*-1 (and/or the first slot symbol 1528*a*) may be fifty (50) as depicted and may be added to a result associated with the second payline 1528*b*. In some embodiments, the value of the counter 1532 may also or alternatively be multiplied (e.g., such as in the case that the counter 1532 tracks a number of slot symbols 1528 that interact with the first special reel position 1530*a*) and/or otherwise interacted with the result of the second payline 1526*b*, thereby altering or adjusting a result of the primary game. In some embodiments, the value of the counter 1532 may also or alternatively define or adjust or affect a result from a secondary game. The player of the second version of the interface 1520*b* may earn or win, for example, a second result from the primary game based on the second payline 1526*b* as well as a secondary or bonus win of (or based on) fifty (50), based on the value of the counter 1532.

According to some embodiments, multiple special matrix positions 1530*a-c* may be utilized and/or such special matrix positions 1530*a-c* may alter or affect slot symbols 1528 that interact with the special matrix positions 1530*a-c*. As depicted in FIG. 15C, for example, a particular state or progression of a slot-style game is shown with respect to a third version of the interface 1520*c* that comprises a third slot matrix 1522*c* and a plurality of special matrix positions 1530*a-c*—e.g., a first special matrix position 1530*a* positioned similarly to the first and second versions of the interface 1520*a-b*, a second special matrix position 1530*b* situated on the first reel 1524*a*, and/or a third special matrix position 1530*c* situated on the third reel 1524*c*. In some embodiments, the various special matrix positions 1530*a-c* may implement various different effects on game play as it progresses. According to some embodiments, game play may be depicted as progressing in an example manner as shown by FIG. 15C and FIG. 15D. The third version of the interface 1520*c* (in FIG. 15C) may comprise the third slot matrix 1522*c* that may represent a third stage and/or time during the slot-style game, for example, while a fourth version of the interface 1520*d* (in FIG. 15D) may comprise a fourth slot matrix 1522*d* that may represent a fourth (or otherwise subsequent) stage and/or time during the slot-style game. The third and fourth versions of the interface 1520*c-d* may, for example, depict a game play progression from the third slot matrix 1522*c* to the fourth slot matrix 1522*d*. For ease of illustration, the depicted progression shows the slot symbols 1528 moving one position downward from initial (or third) positions in the third slot matrix 1522*c* to fourth (or subsequent) positions in the fourth slot matrix 1522*d*.

In some embodiments, an entry of the first slot symbol 1528*a* into the first special reel position 1530*a* may cause the first special attribute 1528*a*-1 to increment or adjust the counter 1532, such as described with respect to the game progression of FIG. 15A and FIG. 15B. The counter 1532 may be incremented by ten (10), for example, causing the value of the counter 1532 to progress from seventy (70) to eighty (80). According to some embodiments, the entry of the first slot symbol 1528*a* into the first special reel position 1530*a* may also or alternatively cause a symbol counter 1532-1 to increment by one (1)—representing a single symbol entry into one of the special reel positions 1530*a-c*.

According to some embodiments, a second slot symbol 1528*b* may leave or pass out of the second special matrix position 1530*b*. In some embodiments, this passing through or out of and/or interaction of the second slot symbol 1528*b* with the second special matrix position 1530*b* may also or alternative cause an incrementing of the symbol counter 1532-1 by one (1)—representing a single symbol pass through or exit from one of the special matrix positions 1530*a-c*. According to some embodiments, the passing through or out of and/or interaction of the second slot symbol 1528*b* with the second special matrix position 1530*b* may also or alternative alter the second slot symbol 1528*b* itself. As depicted, for example, the second slot symbol 1528*b* "Q" may gain a second special attribute 1528*b*-1 upon leaving the second special matrix position 1530*b*.

In some embodiments, a third slot symbol 1528*c* may enter or pass into the third special matrix position 1530*c*. In some embodiments, this passing into and/or interaction of the third slot symbol 1528*c* with the third special matrix position 1530*c* may also or alternative cause an incrementing of the symbol counter 1532-1 by one (1)—representing a single symbol pass through or exit from one of the special matrix positions 1530*a-c*. In such a manner, for example, as each of the first, second, and third symbols 1528*a-c* may increment the symbol counter 1532-1, the value of the symbol counter 1532-1 may progress from zero (0) to three (3). In some embodiments, the passing into and/or interaction of the third slot symbol 1528*c* with the third special matrix position 1530*c* may also or alternative cause a multiplier counter 1532-2 to adjust. As depicted in FIG. 15D, for example, a third special attribute 1528*c*-1 of the third slot symbol 1528*c* may cause the multiplier counter 1532-2 to change from a value of "1×" (e.g., a multiplier of one (1) times) to a value of "3×" (e.g., a multiplier of three (3) times).

According to some embodiments, the passing into and/or interaction of the third slot symbol 1528*c* with the third special matrix position 1530*c* may also or alternative alter the third slot symbol 1528*c* itself. As depicted, for example, the third slot symbol 1528*c*"10" comprising the third special attribute 1528*c*-1, upon entering the third special matrix position 1530*c*, may (i) lose the third special attribute 1528*c*-1 (and/or have a value of the third special attribute 1528*c*-1 changed), and/or (ii) change or morph into a fourth slot symbol 1528*d*. The third slot symbol 1528*c* of the type "10" may, for example, change into (represented by the dotted line "10" in the third special matrix position 1530*c* in the fourth version of the interface 1520*d* of FIG. 15D) the fourth slot symbol 1528*d* of the type "K". In some embodiments, any paylines (not shown in FIG. 15C or FIG. 15D) or other outcomes or respective results of the primary slot-style game may be resolved either prior to the third slot symbol 1528*c* changing into the fourth slot symbol 1528*d*, or after.

In some embodiments, an outcome and/or the result of the primary game may be modified by mathematically and/or logically applying any or all of the values of the counter 1532, the symbol counter 1532-1, and/or the multiplier counter 1532-2. The values of the counters 1532, 1532-1, 1532-2 may be added and/or multiplied with a result and/or may otherwise interacted with the result, thereby altering or adjusting a result of the primary game. In some embodiments, the values of any or all of the counters 1532, 1532-1, 1532-2 may also or alternatively define or adjust or affect a result of a secondary game.

While certain slot symbols 1528, 1528*a*, 1528*b*, 1528*c*, 1528*d*, certain size and/or configuration of slot symbol matrices 1522*a-d*, certain numbers and/or locations of special reel positions 1530*a-c*, certain special attributes 1528*a*-1, 1528*b*-1, 1528*c*-1 (and/or associated reel effects), and/or certain counters 1532, 1532-1, 1532-2 are depicted in FIG.

15A, FIG. 15B, FIG. 15C, and FIG. 15D for convenience and ease of illustration, other quantities, types, and/or configurations of such elements may be implemented without deviating from the scope of some embodiments.

V. Apparatus and Article of Manufacture

Turning to FIG. 16, a block diagram of an apparatus 1610 according to some embodiments is shown. In some embodiments, the apparatus 1610 may be similar in configuration and/or functionality to any of the player and/or user devices 102*a-n*, 202*a-n*, 302*a-b*, 402, 502 and/or the servers and/or controller devices 110, 210*a-n*, 310*a-g*, 410*e-f*, 510*a-j* of FIG. 1, FIG. 2, FIG. 3, FIG. 4, and/or FIG. 5 herein, and/or may otherwise comprise a portion of the systems 100, 200, 300, 400, 500 of FIG. 1, FIG. 2, FIG. 3, FIG. 4, and/or FIG. 5 herein. The apparatus 1610 may, for example, execute, process, facilitate, and/or otherwise be associated with the methods 600, 800, 1000, 1200, 1400 of FIG. 6, FIG. 8, FIG. 10, FIG. 12, and/or FIG. 14 herein, and/or one or more portions and/or combinations thereof. In some embodiments, the apparatus 1610 may comprise a processing device 1612, an input device 1614, an output device 1616, a communication device 1618, an interface 1620, a memory device 1640 (storing various programs and/or instructions 1642 and data 1644), and/or a cooling device 1650. According to some embodiments, any or all of the components 1612, 1614, 1616, 1618, 1620, 1640, 1642, 1644, 1650 of the apparatus 1610 may be similar in configuration and/or functionality to any similarly named and/or numbered components described herein. Fewer or more components 1612, 1614, 1616, 1618, 1620, 1640, 1642, 1644, 1650 and/or various configurations of the components 1612, 1614, 1616, 1618, 1620, 1640, 1642, 1644, 1650 be included in the apparatus 1610 without deviating from the scope of embodiments described herein.

According to some embodiments, the processing device 1612 may be or include any type, quantity, and/or configuration of electronic and/or computerized processor that is or becomes known. The processing device 1612 may comprise, for example, an Intel® IXP 2800 network processor or an Intel® XEON™ Processor coupled with an Intel® E7501 chipset. In some embodiments, the processing device 1612 may comprise multiple inter-connected processors, microprocessors, and/or micro-engines. According to some embodiments, the processing device 1612 (and/or the apparatus 1610 and/or portions thereof) may be supplied power via a power supply (not shown) such as a battery, an Alternating Current (AC) source, a Direct Current (DC) source, an AC/DC adapter, solar cells, and/or an inertial generator. In the case that the apparatus 1610 comprises a server such as a blade server, necessary power may be supplied via a standard AC outlet, power strip, surge protector, a PDU, and/or Uninterruptible Power Supply (UPS) device.

In some embodiments, the input device 1614 and/or the output device 1616 are communicatively coupled to the processing device 1612 (e.g., via wired and/or wireless connections and/or pathways) and they may generally comprise any types or configurations of input and output components and/or devices that are or become known, respectively. The input device 1614 may comprise, for example, a keyboard that allows an operator of the apparatus 1610 to interface with the apparatus 1610 (e.g., by a player, such as to participate in a slot-style game as described herein). In some embodiments, the input device 1614 may comprise a sensor configured to provide information such as player input to the apparatus 1610 and/or the processing device 1612. The output device 1616 may, according to some embodiments, comprise a display screen and/or other practicable output component and/or device. The output device 1616 may, for example, provide a game interface (such as the interface 1620 and/or one or more of the interfaces 720*a-c*, 920*a-b*, 1120, 1320, 1520*a-d* of FIG. 7A, FIG. 7B, FIG. 7C, FIG. 9A, FIG. 9B, FIG. 11, FIG. 13, FIG. 15A, FIG. 15B, FIG. 15C, and/or FIG. 15D herein) to a player (e.g., via a website). According to some embodiments, the input device 1614 and/or the output device 1616 may comprise and/or be embodied in a single device such as a touch-screen monitor.

In some embodiments, the communication device 1618 may comprise any type or configuration of communication device that is or becomes known or practicable. The communication device 1618 may, for example, comprise a network interface card (NIC), a telephonic device, a cellular network device, a router, a hub, a modem, and/or a communications port or cable. In some embodiments, the communication device 1618 may be coupled to provide data to a player device (not shown in FIG. 16, in the case that the apparatus 1610 does not itself comprise a player device), such as in the case that the apparatus 1610 is utilized to provide a game interface to a player as described herein. The communication device 1618 may, for example, comprise a cellular telephone network transmission device that sends signals indicative of game interface components to customer and/or subscriber handheld, mobile, and/or telephone device. According to some embodiments, the communication device 1618 may also or alternatively be coupled to the processing device 1612. In some embodiments, the communication device 1618 may comprise an IR, RF, Bluetooth™, and/or Wi-Fi® network device coupled to facilitate communications between the processing device 1612 and another device (such as a player device and/or a third-party device).

The memory device 1640 may comprise any appropriate information storage device that is or becomes known or available, including, but not limited to, units and/or combinations of magnetic storage devices (e.g., a hard disk drive), optical storage devices, and/or semiconductor memory devices such as RAM devices, Read Only Memory (ROM) devices, Single Data Rate Random Access Memory (SDR-RAM), Double Data Rate Random Access Memory (DDR-RAM), and/or Programmable Read Only Memory (PROM). The memory device 1640 may, according to some embodiments, store one or more of game instructions 1642-1, interface instructions 1642-2, player data 1644-1, game data 1644-2, tournament data 1644-3, and/or prize data 1644-4. In some embodiments, the game instructions 1642-1, interface instructions 1642-2, player data 1644-1, game data 1644-2, tournament data 1644-3, and/or prize data 1644-4 may be utilized by the processing device 1612 to provide output information via the output device 1616 and/or the communication device 1618.

According to some embodiments, the game instructions 1642-1 may be operable to cause the processing device 1612 to process player data 1644-1, game data 1644-2, tournament data 1644-3, and/or prize data 1644-4. Player data 1644-1, game data 1644-2, tournament data 1644-3, and/or prize data 1644-4 received via the input device 1614 and/or the communication device 1618 may, for example, be analyzed, sorted, filtered, decoded, decompressed, ranked, scored, plotted, and/or otherwise processed by the processing device 1612 in accordance with the game instructions 1642-1. In some embodiments, player data 1644-1, game data 1644-2, tournament data 1644-3, and/or prize data

1644-4 may be fed by the processing device 1612 through one or more mathematical and/or statistical formulas and/or models in accordance with the game instructions 1642-1 to provide slot-style games having features and/or functionality in accordance with embodiments described herein.

In some embodiments, the interface instructions 1642-2 may be operable to cause the processing device 1612 to process player data 1644-1, game data 1644-2, tournament data 1644-3, and/or prize data 1644-4. Player data 1644-1, game data 1644-2, tournament data 1644-3, and/or prize data 1644-4 received via the input device 1614 and/or the communication device 1618 may, for example, be analyzed, sorted, filtered, decoded, decompressed, ranked, scored, plotted, and/or otherwise processed by the processing device 1612 in accordance with the interface instructions 1642-2. In some embodiments, player data 1644-1, game data 1644-2, tournament data 1644-3, and/or prize data 1644-4 may be fed by the processing device 1612 through one or more mathematical and/or statistical formulas and/or models in accordance with the interface instructions 1642-2 to provide one or more game interfaces (such as one or more of the interfaces 720*a-c*, 920*a-b*, 1120, 1320, 1520*a-d*, 1620 of FIG. 7A, FIG. 7B, FIG. 7C, FIG. 9A, FIG. 9B, FIG. 11, FIG. 13, FIG. 15A, FIG. 15B, FIG. 15C, FIG. 15D, and/or FIG. 16 herein) such as to provide slot-style games having functionality in accordance with embodiments described herein.

Any or all of the exemplary instructions and data types described herein and other practicable types of data may be stored in any number, type, and/or configuration of memory devices that is or becomes known. The memory device 1640 may, for example, comprise one or more data tables or files, databases, table spaces, registers, and/or other storage structures. In some embodiments, multiple databases and/or storage structures (and/or multiple memory devices 1640) may be utilized to store information associated with the apparatus 1610. According to some embodiments, the memory device 1640 may be incorporated into and/or otherwise coupled to the apparatus 1610 (e.g., as shown) or may simply be accessible to the apparatus 1610 (e.g., externally located and/or situated).

In some embodiments, the apparatus 1610 may comprise a cooling device 1650. According to some embodiments, the cooling device 1650 may be coupled (physically, thermally, and/or electrically) to the processing device 1612 and/or to the memory device 1640. The cooling device 1650 may, for example, comprise a fan, heat sink, heat pipe, radiator, cold plate, and/or other cooling component or device or combinations thereof, configured to remove heat from portions or components of the apparatus 1610.

Referring now to FIG. 17A, FIG. 17B, FIG. 17C, FIG. 17D, and FIG. 17E, perspective diagrams of exemplary data storage devices 1740*a-e* according to some embodiments are shown. The data storage devices 1740*a-e* may, for example, be utilized to store instructions and/or data such as the game instructions 1642-1, interface instructions 1642-2, player data 1644-1, game data 1644-2, tournament data 1644-3, and/or prize data 1644-4, each of which is described in reference to FIG. 16 herein. In some embodiments, instructions stored on the data storage devices 1740*a-e* may, when executed by a processor, cause the implementation of and/or facilitate the methods 600, 800, 1000, 1200, 1400 of FIG. 6, FIG. 8, FIG. 10, FIG. 12, and/or FIG. 14 herein, and/or one or more portions and/or combinations thereof described herein.

According to some embodiments, the first data storage device 1740*a* may comprise one or more various types of internal and/or external hard drives. The first data storage device 1740*a* may, for example, comprise a data storage medium 1746 that is read, interrogated, and/or otherwise communicatively coupled to and/or via a disk reading device 1748. In some embodiments, the first data storage device 1740*a* and/or the data storage medium 1746 may be configured to store information utilizing one or more magnetic, inductive, and/or optical means (e.g., magnetic, inductive, and/or optical-encoding). The data storage medium 1746, depicted as a first data storage medium 1746*a* for example (e.g., breakout cross-section "A"), may comprise one or more of a polymer layer 1746*a*-1, a magnetic data storage layer 1746*a*-2, a non-magnetic layer 1746*a*-3, a magnetic base layer 1746*a*-4, a contact layer 1746*a*-5, and/or a substrate layer 1746*a*-6. According to some embodiments, a magnetic read head 1746*a* may be coupled and/or disposed to read data from the magnetic data storage layer 1746*a*-2.

In some embodiments, the data storage medium 1746, depicted as a second data storage medium 1746*b* for example (e.g., breakout cross-section "B"), may comprise a plurality of data points 1746*b*-2 disposed with the second data storage medium 1746*b*. The data points 1746*b*-2 may, in some embodiments, be read and/or otherwise interfaced with via a laser-enabled read head 1748*b* disposed and/or coupled to direct a laser beam through the second data storage medium 1746*b*.

In some embodiments, the second data storage device 1740*b* may comprise a CD, CD-ROM, DVD, Blu-Ray™ Disc, and/or other type of optically-encoded disk and/or other storage medium that is or becomes known or practicable. In some embodiments, the third data storage device 1740*c* may comprise a USB keyfob, dongle, and/or other type of flash memory data storage device that is or becomes know or practicable. In some embodiments, the fourth data storage device 1740*d* may comprise RAM of any type, quantity, and/or configuration that is or becomes practicable and/or desirable. In some embodiments, the fourth data storage device 1740*d* may comprise an off-chip cache such as a Level 2 (L2) cache memory device. According to some embodiments, the fifth data storage device 1740*e* may comprise an on-chip memory device such as a Level 1 (L1) cache memory device.

The data storage devices 1740*a-e* may generally store program instructions, code, and/or modules that, when executed by a processing device cause a particular machine to function in accordance with one or more embodiments described herein. The data storage devices 1740*a-e* depicted in FIG. 17A, FIG. 17B, FIG. 17C, FIG. 17D, and FIG. 17E are representative of a class and/or subset of computer-readable media that are defined herein as "computer-readable memory" (e.g., non-transitory memory devices as opposed to transmission devices or media).

The terms "computer-readable medium" and "computer-readable memory" refer to any medium that participates in providing data (e.g., instructions) that may be read by a computer and/or a processor. Such a medium may take many forms, including but not limited to non-volatile media, volatile media, and other specific types of transmission media. Non-volatile media include, for example, optical or magnetic disks and other persistent memory. Volatile media include DRAM, which typically constitutes the main memory. Other types of transmission media include coaxial cables, copper wire, and fiber optics, including the wires that comprise a system bus coupled to the processor.

Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable medium" and/or "tangible media" specifically exclude signals, waves, and wave forms or other intangible or transitory media that may nevertheless be readable by a computer.

Various forms of computer-readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined above and includes many exemplary protocols that are also applicable here.

In some embodiments, one or more specialized machines such as a computerized processing device, a server, a remote terminal, and/or a customer device may implement the various practices described herein. A computer system of an game provider may, for example, comprise various specialized computers that interact to provide for slot-style games as described herein.

VI. Rules of Interpretation

Numerous embodiments are described in this patent application, and are presented for illustrative purposes only. The described embodiments are not, and are not intended to be, limiting. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments of the invention nor a listing of features of the invention that must be present in all embodiments. It is contemplated, however, that while some embodiment are not limited by the examples provided herein, some embodiments may be specifically bounded or limited by provided examples, structures, method steps, and/or sequences. Embodiments having scopes limited by provided examples may also specifically exclude features not explicitly described or contemplated.

Neither the Title (set forth at the beginning of the first page of this patent application) nor the Abstract (set forth at the end of this patent application) is to be taken as limiting in any way the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise. Similarly, any reference to an "alternate", "alternative", and/or "alternate embodiment" is intended to connote one or more possible variations—not mutual exclusivity. In other words, it is expressly contemplated that "alternatives" described herein may be utilized and/or implemented together, unless they inherently are incapable of being utilized together.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including the specification, its claims and figures, and anything which may be incorporated by reference, unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on". In some embodiments, a first thing being "based on" a second thing refers specifically to the first thing taking into account the second thing in an explicit manner. In such embodiments, for example, a processing step based on the local weather, which itself is in some manner based on or affected by (for example) human activity in the rainforests, is not "based on" such human activities because it is not those activities that being explicitly analyzed, included, taken into account, and/or processed.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "wherein", as utilized herein, does not evidence intended use. The term "wherein" expressly refers to one or more features inclusive in a particular embodiment and does not imply or include an optional or conditional limitation.

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to allow for distinguishing that particular referenced feature from another feature that is described by the same term or by a similar term. For example, a "first widget" may be so named merely to allow for distinguishing it in one or more claims from a "second widget", so as to encompass embodiments in which (1) the "first widget" is or is the same as the "second widget" and (2) the "first widget" is different than or is not identical to the "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; (3) does not indicate that either widget ranks above or below any other, as in importance or quality; and (4) does not indicate that the two referenced widgets are not identical or the same widget. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices which are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this patent application and the title of this patent application are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining and the like.

It will be readily apparent that the various methods and algorithms described herein may be implemented by, e.g., appropriately and/or specially-programmed general purpose computers and/or computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software A "processor" generally means any one or more microprocessors, CPU devices, computing devices, microcontrollers, digital signal processors, or like devices, as further described herein. According to some embodiments, a "processor" may primarily comprise and/or be limited to a specific class of processors referred to herein as "processing devices". "Processing devices" are a subset of processors limited to physical devices such as CPU devices, Printed Circuit Board (PCB) devices, transistors, capacitors, logic gates, etc. "Processing devices", for example, explicitly exclude biological, software-only, and/or biological or software-centric physical devices. While processing devices may include some degree of soft logic and/or programming, for example, such devices must include a predominant degree of physical structure in accordance with 35 U.S.C. § 101.

The term "computer-readable medium" refers to any medium that participates in providing data (e.g., instructions or other information) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave, or any other medium from which a computer can read.

The term "computer-readable memory" may generally refer to a subset and/or class of computer-readable medium that does not include transmission media such as waveforms, carrier waves, electromagnetic emissions, etc. Computer-readable memory may typically include physical media upon which data (e.g., instructions or other information) are stored, such as optical or magnetic disks and other persistent memory, DRAM, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, computer hard drives, backup tapes, Universal Serial Bus (USB) memory devices, and the like.

Various forms of computer readable media may be involved in carrying data, including sequences of instructions, to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database.

The present invention can be configured to work in a network environment including a computer that is in communication, via a communications network, with one or more devices. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A method, comprising:

determining, by a processing device, a three-dimensional array of reel symbols for a slot-style game, the array comprising, for each layer of depth in the array, a two-dimensional reel symbol matrix, each reel symbol in each matrix being identifiable by a particular two-dimensional position, wherein a first two-dimensional matrix is populated with reel symbols based on a first Return-To-Player (RTP) probability and a second two-dimensional matrix is populated with reel symbols based on a second RTP probability different than the first RTP probability, wherein the second RTP probability is higher than the first RTP probability;

determining, by the processing device and based on a reel symbol removal mechanic, a first reel symbol to remove from the first two-dimensional matrix of the three-dimensional array;

determining, by the processing device, a second reel symbol from the second two-dimensional matrix of the three-dimensional array, the second reel symbol having the same two-dimensional position as the first reel symbol; and causing, by the processing device, the second reel symbol to replace the first reel symbol.

2. The method of claim 1, wherein the first two-dimensional matrix is associated with a first depth in the three-dimensional array and wherein the second two-dimensional matrix is associated with a second depth in the three-dimensional array, the first and second depths comprising adjacent depths.

3. The method of claim 2, wherein the first depth comprises a game result datum.

4. The method of claim 1, further comprising:

determining, by the processing device and after the causing of the second reel symbol to replace the first reel symbol and based on the first two-dimensional matrix, a first outcome of the game.

5. The method of claim 4, further comprising:

determining, by the processing device and after the causing of the second reel symbol to replace the first reel symbol and based on the second two-dimensional matrix, a second outcome of the game.

* * * * *